US009625105B2

(12) United States Patent
Tong et al.

(10) Patent No.: US 9,625,105 B2
(45) Date of Patent: Apr. 18, 2017

(54) LED LAMP WITH ACTIVE COOLING ELEMENT

(75) Inventors: Tao Tong, Oxnard, CA (US); Mark Youmans, Goleta, CA (US); Yejin He, Santa Barbara, CA (US)

(73) Assignee: CREE, INC., Durham, NC (US)

( * ) Notice: Subject to any disclaimer, the term of this patent is extended or adjusted under 35 U.S.C. 154(b) by 201 days.

(21) Appl. No.: 12/985,275

(22) Filed: Jan. 5, 2011

(65) Prior Publication Data

US 2011/0215697 A1 Sep. 8, 2011

Related U.S. Application Data

(63) Continuation-in-part of application No. 12/848,825, filed on Aug. 2, 2010, and a continuation-in-part of
(Continued)

(51) Int. Cl.
*F21V 29/00* (2015.01)
*F21K 99/00* (2016.01)
(Continued)

(52) U.S. Cl.
CPC ..... *F21K 9/135* (2013.01); *F21K 9/232* (2016.08); *F21K 9/64* (2016.08); *F21V 3/02* (2013.01);
(Continued)

(58) Field of Classification Search
CPC . F21K 9/23–9/233; F21V 29/70–29/81; F21V 29/83
(Continued)

(56) References Cited

U.S. PATENT DOCUMENTS 2,394,992 A 2/1946 Frank ..... 362/311.12
3,143,592 A 8/1964 William ..... 174/16.3
(Continued)

FOREIGN PATENT DOCUMENTS

CN 1425117 6/2003
CN 1465106 A 12/2003
(Continued)

OTHER PUBLICATIONS

International Search Report and Written Opinion for counterpart PCT Application No. PCT/US2011/000391 mailed Oct. 6, 2011.
(Continued)

*Primary Examiner* — Sean Gramling
(74) *Attorney, Agent, or Firm* — Koppel, Patrick, Heybl & Philpott

(57) ABSTRACT

Solid state lamp or bulb structures are disclosed that can provide an essentially omnidirectional emission pattern from directional emitting light sources, such as forward emitting light sources. The present invention is also directed to lamp structures using active elements to assist in thermal management of the lamp structures and in some embodiments to reduce the convective thermal resistance around certain of the lamp elements to increase the natural heat convection away from the lamp. Some embodiments include integral fans or other active elements that move air over the surfaces of a heat sink, while other embodiments comprise internal fans or other active elements that can draw air internal to the lamp. The fan's movement of the air over these surfaces can agitate otherwise stagnant air to decrease the convective thermal resistance and increasing the ability of the lamp to dissipate heat generated during operation.

35 Claims, 12 Drawing Sheets

Related U.S. Application Data application No. 12/889,719, filed on Sep. 24, 2010, and a continuation-in-part of application No. 12/975,820, filed on Dec. 22, 2010.

(60) Provisional application No. 61/339,516, filed on Mar. 3, 2010, provisional application No. 61/339,515, filed on Mar. 3, 2010, provisional application No. 61/386,437, filed on Sep. 24, 2010, provisional application No. 61/424,665, filed on Dec. 19, 2010, provisional application No. 61/424,670, filed on Dec. 19, 2010.

(51) Int. Cl.

| | |
|---|---|
| ***F21V 29/67*** | (2015.01) |
| ***F21V 29/02*** | (2006.01) |
| ***F21V 3/02*** | (2006.01) |
| ***F21V 29/506*** | (2015.01) |
| ***F21V 29/77*** | (2015.01) |
| ***F21K 9/232*** | (2016.01) |
| ***F21K 9/64*** | (2016.01) |
| *F21V 29/505* | (2015.01) |
| *F21Y 101/00* | (2016.01) |
| *F21Y 115/10* | (2016.01) |
| *F21Y 107/40* | (2016.01) |

(52) U.S. Cl.
CPC ..... *F21V 29/02* (2013.01); *F21V 29/506* (2015.01); *F21V 29/67* (2015.01); *F21V 29/773* (2015.01); *F21V 29/505* (2015.01); *F21Y 2101/00* (2013.01); *F21Y 2107/40* (2016.08); *F21Y 2115/10* (2016.08)

(58) Field of Classification Search
USPC ..... 362/249.02, 294, 373
See application file for complete search history.

(56) References Cited

U.S. PATENT DOCUMENTS

| | | | | |
|---|---|---|---|---|
| 3,581,162 | A | 5/1971 | Wheatley | |
| 4,204,246 | A | 5/1980 | Arii et al. | 361/699 |
| 4,219,871 | A | 8/1980 | Larrimore | 362/264 |
| 5,463,280 | A | 10/1995 | Johnson | |
| 5,535,230 | A | 7/1996 | Abe | |
| 5,561,346 | A | 10/1996 | Byrne | |
| 5,581,683 | A | 12/1996 | Bertignoll et al. | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,838,101 | A | 11/1998 | Pappalardo | 313/487 |
| 5,890,794 | A | 4/1999 | Abtahi et al. | |
| 5,934,798 | A | 8/1999 | Roller et al. | 362/497 |
| 5,947,588 | A | 9/1999 | Huang | |
| 5,949,347 | A | 9/1999 | Wu | |
| 6,218,785 | B1 | 4/2001 | Incerti | 315/185 S |
| 6,220,722 | B1 | 4/2001 | Begemann | |
| 6,220,731 | B1 | 4/2001 | Ryan | 362/373 |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,270,722 | B1 | 8/2001 | Yang et al. | 422/37 |
| 6,276,822 | B1 | 8/2001 | Bedrosian et al. | |
| 6,350,041 | B1 | 2/2002 | Tarsa | |
| 6,404,131 | B1 | 6/2002 | Kawano et al. | 315/82 |
| 6,465,961 | B1 | 10/2002 | Cao | 315/58 |
| 6,517,221 | B1 | 2/2003 | Xie | 362/373 |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,746,885 | B2 | 6/2004 | Cao | 438/26 |
| 6,758,582 | B1 | 7/2004 | Hsiao | 362/302 |
| 6,764,202 | B1 | 7/2004 | Herring et al. | 362/371 |
| 6,803,607 | B1 | 10/2004 | Chan et al. | |
| 6,848,819 | B1 | 2/2005 | Arndt et al. | |
| 6,860,620 | B2 | 3/2005 | Kuan et al. | 362/294 |
| 6,864,513 | B2 | 3/2005 | Lin et al. | |
| 6,910,794 | B2 | 6/2005 | Rice | 362/547 |
| 6,948,829 | B2 | 9/2005 | Verdes et al. | |
| 6,982,518 | B2 | 1/2006 | Chou et al. | |
| 6,997,580 | B2 | 2/2006 | Wong | 362/311.02 |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,094,362 | B2 * | 8/2006 | Setlur et al. | 252/301.4 F |
| 7,140,753 | B2 | 11/2006 | Wang et al. | 362/294 |
| 7,144,135 | B2 | 12/2006 | Martin et al. | |
| 7,160,012 | B2 | 1/2007 | Hilscher et al. | |
| 7,160,120 | B2 | 1/2007 | Zhang et al. | |
| 7,165,866 | B2 | 1/2007 | Li | |
| 7,172,314 | B2 | 2/2007 | Currie et al. | |
| 7,213,940 | B1 | 5/2007 | Van de Ven | 257/89 |
| D546,980 | S | 7/2007 | Lo | |
| 7,250,715 | B2 | 7/2007 | Mueller | 313/485 |
| 7,270,446 | B2 | 9/2007 | Chang et al. | 362/294 |
| D553,267 | S | 10/2007 | Yuen | |
| 7,350,936 | B2 | 4/2008 | Ducharme et al. | 362/231 |
| 7,354,174 | B1 | 4/2008 | Yan | |
| 7,377,674 | B2 | 5/2008 | Klinkman et al. | 362/484 |
| 7,396,142 | B2 | 7/2008 | Laizure, Jr. et al. | |
| 7,405,857 | B2 | 7/2008 | Ma et al. | |
| 7,413,325 | B2 | 8/2008 | Chen | 362/249.01 |
| D581,556 | S | 11/2008 | To et al. | D26/2 |
| 7,547,124 | B2 | 6/2009 | Chang et al. | 362/373 |
| 7,549,782 | B2 | 6/2009 | Ng et al. | 362/555 |
| 7,553,047 | B2 | 6/2009 | Shin et al. | 362/294 |
| 7,600,882 | B1 | 10/2009 | Morejon et al. | |
| 7,607,802 | B2 | 10/2009 | Kang et al. | 362/294 |
| 7,614,759 | B2 | 11/2009 | Negley | |
| 7,618,157 | B1 | 11/2009 | Galvez | |
| 7,663,315 | B1 | 2/2010 | Hulse | |
| 7,686,478 | B1 | 3/2010 | Hulse | |
| 7,710,016 | B2 | 5/2010 | Miki | 257/98 |
| 7,726,836 | B2 | 6/2010 | Chen | |
| 7,740,365 | B2 | 6/2010 | Huttner et al. | 362/97 |
| 7,753,568 | B2 | 7/2010 | Hu et al. | 362/373 |
| 7,810,954 | B2 | 10/2010 | Kolodin | 362/277 |
| 7,824,065 | B2 | 11/2010 | Maxik | |
| D629,928 | S | 12/2010 | Chen et al. | |
| 7,884,538 | B2 | 2/2011 | Mitsuishi et al. | 313/502 |
| 7,909,481 | B1 | 3/2011 | Zhang | 362/249.02 |
| 7,976,335 | B2 | 7/2011 | Weber et al. | 439/487 |
| 7,989,236 | B2 | 8/2011 | Yamaguchi et al. | 438/26 |
| 8,021,025 | B2 | 9/2011 | Lee | |
| 8,235,571 | B2 | 8/2012 | Park | 362/555 |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,309,969 | B2 | 11/2012 | Suehiro et al. | 257/79 |
| 8,314,537 | B2 | 11/2012 | Gielen et al. | 313/46 |
| 8,322,896 | B2 | 12/2012 | Falicoff et al. | |
| 8,348,470 | B2 | 1/2013 | Liu et al. | 362/294 |
| 8,371,722 | B2 | 2/2013 | Carroll | |
| 8,400,051 | B2 | 3/2013 | Hakata et al. | |
| 8,410,512 | B2 | 4/2013 | Andrews | 257/99 |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,568,009 | B2 | 10/2013 | Chiang et al. | 362/563 |
| 8,641,237 | B2 | 2/2014 | Chuang | |
| 8,653,723 | B2 | 2/2014 | Cao et al. | |

(56) References Cited

U.S. PATENT DOCUMENTS 8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
8,922,106 B2 12/2014 Helbing et al. ..... 313/318.11
9,316,386 B2 4/2016 Breidenassel
2002/0047516 A1 4/2002 Iwasa et al. ..... 313/512
2002/0114169 A1 8/2002 Harada ..... 362/558
2003/0021113 A1 1/2003 Begemann
2003/0038291 A1 2/2003 Cao
2003/0081419 A1 5/2003 Jacob ..... 362/364
2003/0185005 A1 10/2003 Sommers et al.
2004/0021629 A1 2/2004 Sasuga et al.
2004/0159846 A1 8/2004 Doxsee
2004/0201990 A1 10/2004 Meyer
2004/0223315 A1 11/2004 Suehiro et al. ..... 362/84
2005/0068776 A1 3/2005 Ge ..... 362/296.08
2005/0168990 A1 8/2005 Nagata et al. ..... 362/294
2005/0174780 A1* 8/2005 Park ..... 362/294
2005/0184638 A1 8/2005 Mueller ..... 313/485
2005/0219060 A1 10/2005 Curran et al. ..... 340/815.45
2005/0225988 A1 10/2005 Chaves et al.
2005/0242711 A1 11/2005 Bloomfield
2005/0276053 A1 12/2005 Nortrup et al. ..... 362/294
2006/0097245 A1 5/2006 Aanegola et al. ..... 257/26
2006/0097385 A1 5/2006 Negley ..... 257/722
2006/0115482 A1 6/2006 Sauer et al. ..... 438/22
2006/0138435 A1 6/2006 Tarsa et al. ..... 257/89
2006/0152140 A1 7/2006 Brandes ..... 313/503
2006/0152820 A1 7/2006 Lien et al. ..... 359/726
2006/0180774 A1 8/2006 Endo ..... 250/485.1
2006/0227558 A1 10/2006 Osawa et al.
2006/0250792 A1 11/2006 Izardel ..... 362/231
2007/0047232 A1 3/2007 Kim et al.
2007/0090737 A1 4/2007 Hu et al. ..... 313/11
2007/0091633 A1 4/2007 Harrity et al.
2007/0139938 A1 6/2007 Petroski
2007/0139949 A1 6/2007 Tanda et al. ..... 362/551
2007/0158668 A1 7/2007 Tarsa et al. ..... 257/98
2007/0182299 A1 8/2007 Ouderkirk ..... 313/110
2007/0206375 A1 9/2007 Lys
2007/0215890 A1 9/2007 Harbers et al.
2007/0223219 A1 9/2007 Medendorp
2007/0263405 A1 11/2007 Ng et al. ..... 362/555
2007/0267976 A1 11/2007 Bohler et al. ..... 315/112
2007/0274080 A1 11/2007 Negley et al. ..... 362/341
2007/0285924 A1 12/2007 Morris et al. ..... 362/264
2007/0297183 A1 12/2007 Coushaine
2008/0037257 A1 2/2008 Bolta
2008/0055908 A1 3/2008 Wu et al. ..... 362/294
2008/0062694 A1 3/2008 Lai et al. ..... 362/294
2008/0080165 A1 4/2008 Kim et al.
2008/0093615 A1 4/2008 Lin et al.
2008/0106893 A1 5/2008 Johnson et al.
2008/0117620 A1 5/2008 Hama et al. ..... 362/84
2008/0128735 A1 6/2008 Yoo et al.
2008/0149166 A1 6/2008 Beeson et al. ..... 136/248
2008/0173884 A1 7/2008 Chitnis et al. ..... 257/98
2008/0179611 A1 7/2008 Chitnis et al. ..... 257/98
2008/0232119 A1 9/2008 Ribarich ..... 362/373
2008/0285279 A1 11/2008 Ng et al. ..... 362/249
2008/0308825 A1 12/2008 Chakraborty et al. ..... 257/98
2009/0001399 A1 1/2009 Diana et al. ..... 257/98
2009/0015137 A1 1/2009 Su et al. ..... 313/503
2009/0040760 A1 2/2009 Chen et al. ..... 362/249
2009/0046473 A1* 2/2009 Tsai et al. ..... 362/373
2009/0058256 A1 3/2009 Mitsuishi et al. ..... 313/487
2009/0059559 A1 3/2009 Pabst
2009/0067180 A1 3/2009 Tahmosybayat ..... 362/339
2009/0086492 A1 4/2009 Meyer
2009/0086508 A1 4/2009 Bierhuizen ..... 362/617
2009/0095960 A1 4/2009 Murayama ..... 257/79
2009/0101930 A1 4/2009 Li
2009/0103293 A1 4/2009 Harbers et al. ..... 362/231
2009/0103296 A1 4/2009 Harbers et al.
2009/0116217 A1 5/2009 Teng et al.
2009/0140633 A1 6/2009 Tanimoto ..... 313/503
2009/0141474 A1 6/2009 Kolodin
2009/0175041 A1 7/2009 Yuen et al.
2009/0184618 A1 7/2009 Hakata et al.
2009/0190353 A1 7/2009 Barker ..... 362/249
2009/0195186 A1 8/2009 Guest et al. ..... 315/294
2009/0201679 A1 8/2009 Konaka ..... 362/235
2009/0208307 A1 8/2009 Haase ..... 362/234
2009/0217970 A1 9/2009 Zimmerman et al. ..... 136/252
2009/0262516 A1 10/2009 Li ..... 362/84
2009/0273727 A1 11/2009 Kubota et al. ..... 349/62
2009/0273924 A1 11/2009 Chiang ..... 362/241
2009/0283779 A1 11/2009 Negley et al. ..... 257/88
2009/0286337 A1 11/2009 Lee ..... 438/27
2009/0296387 A1 12/2009 Reisenauer et al. ..... 362/235
2009/0310368 A1 12/2009 Incerti ..... 362/326
2009/0316073 A1 12/2009 Chen et al. ..... 349/64
2009/0316383 A1 12/2009 Son
2009/0322197 A1 12/2009 Helbing ..... 445/48
2009/0322208 A1 12/2009 Shaikevitch ..... 313/503
2009/0322800 A1 12/2009 Atkins ..... 345/690
2009/0323333 A1 12/2009 Chang
2010/0014839 A1 1/2010 Benoy et al. ..... 386/117
2010/0020547 A1 1/2010 Olsson ..... 362/311
2010/0025700 A1 2/2010 Jung et al.
2010/0026185 A1* 2/2010 Betsuda et al. ..... 315/32
2010/0027258 A1 2/2010 Maxik et al. ..... 362/240
2010/0038660 A1 2/2010 Shuja ..... 257/98
2010/0046231 A1 2/2010 Medinis ..... 362/294
2010/0060144 A1 3/2010 Justel et al. ..... 313/503
2010/0079061 A1 4/2010 Tsai ..... 313/504
2010/0091487 A1 4/2010 Shin ..... 362/235
2010/0096967 A1 4/2010 Marinus et al. ..... 313/46
2010/0102707 A1 4/2010 Fukuda et al. ..... 313/503
2010/0134047 A1 6/2010 Hasnain
2010/0140655 A1 6/2010 Shi ..... 257/99
2010/0149783 A1 6/2010 Takenaka et al. ..... 362/84
2010/0149814 A1* 6/2010 Zhai et al. ..... 362/293
2010/0155763 A1 6/2010 Donofrio
2010/0170075 A1 7/2010 Kanade et al. ..... 29/428
2010/0177522 A1 7/2010 Lee ..... 362/373
2010/0201284 A1 8/2010 Kraus
2010/0207502 A1 8/2010 Cao et al. ..... 313/46
2010/0219735 A1 9/2010 Sakai et al. ..... 313/46
2010/0232134 A1 9/2010 Tran ..... 362/84
2010/0244729 A1 9/2010 Chen et al. ..... 315/291
2010/0246165 A1 9/2010 Diaz et al. ..... 362/183
2010/0259918 A1 10/2010 Rains, Jr. ..... 362/84
2010/0264799 A1 10/2010 Liu et al. ..... 313/46
2010/0264826 A1 10/2010 Yatsuda ..... 315/112
2010/0314985 A1 12/2010 Premysler ..... 313/46
2010/0327745 A1 12/2010 Dassanayake ..... 315/35
2010/0327755 A1 12/2010 Meijer ..... 313/485
2010/0328925 A1 12/2010 Hoelen ..... 362/84
2011/0037368 A1 2/2011 Huang ..... 313/46
2011/0044022 A1 2/2011 Ko et al. ..... 362/84
2011/0058379 A1 3/2011 Diamantidis ..... 362/296.01
2011/0068356 A1 3/2011 Chiang et al. ..... 257/98
2011/0074271 A1 3/2011 Takeshi et al. ..... 313/46
2011/0074296 A1 3/2011 Shen et al. ..... 315/112
2011/0080096 A1 4/2011 Dudik et al. ..... 315/112
2011/0080740 A1 4/2011 Allen ..... 362/294
2011/0089804 A1 4/2011 Mahalingam et al. ..... 313/46
2011/0089830 A1 4/2011 Pickard et al. ..... 315/32
2011/0095686 A1 4/2011 Falicoff et al. ..... 315/35
2011/0133222 A1* 6/2011 Allen et al. ..... 257/88
2011/0149563 A1 6/2011 Hsia ..... 362/221
2011/0149578 A1 6/2011 Niiyama ..... 362/294
2011/0175528 A1 7/2011 Rains et al. ..... 315/51
2011/0176316 A1 7/2011 Phipps et al.
2011/0205733 A1 8/2011 Lenderink et al. ..... 362/231
2011/0215696 A1 9/2011 Tong et al. ..... 313/46
2011/0216523 A1 9/2011 Tong et al. ..... 362/84
2011/0242816 A1 10/2011 Chowdhury et al. ..... 362/294
2011/0267835 A1 11/2011 Boonekamp et al. ..... 362/555
2011/0273072 A1 11/2011 Oki ..... 313/46
2011/0278609 A1 11/2011 Jeong ..... 257/98

(56) References Cited

U.S. PATENT DOCUMENTS

| | | | | |
|---|---|---|---|---|
| 2011/0291560 | A1 | 12/2011 | Wang et al. | 315/32 |
| 2011/0298371 | A1 | 12/2011 | Brandes et al. | 315/32 |
| 2012/0040585 | A1 | 2/2012 | Huang | |
| 2012/0155059 | A1 | 6/2012 | Hoelen et al. | 362/84 |
| 2012/0161626 | A1 | 6/2012 | Van de Ven et al. | 315/35 |
| 2012/0241778 | A1 | 9/2012 | Franck | 257/88 |
| 2012/0320591 | A1 | 12/2012 | Liao et al. | 362/249 |
| 2013/0049018 | A1 | 2/2013 | Ramer et al. | 257/81 |
| 2013/0063945 | A1 | 3/2013 | Wu et al. | 362/249 |
| 2013/0119280 | A1 | 5/2013 | Fuchi et al. | 250/504 R |
| 2013/0249374 | A1 | 9/2013 | Lee et al. | 313/12 |
| 2013/0293098 | A1 | 11/2013 | Li et al. | 313/512 |

FOREIGN PATENT DOCUMENTS

| | | | |
|---|---|---|---|
| CN | 1608326 | | 4/2005 |
| CN | 1726410 | | 1/2006 |
| CN | 1802533 | | 7/2006 |
| CN | 1922286 | A | 2/2007 |
| CN | 101012916 | A | 8/2007 |
| CN | 101128695 | | 2/2008 |
| CN | 101262032 | | 9/2008 |
| CN | 101262032 | A | 9/2008 |
| CN | 10126232 | A | 10/2008 |
| CN | 101262032 | | 10/2008 |
| CN | 1013388887 | A | 1/2009 |
| CN | 101368719 | A | 2/2009 |
| CN | 101440938 | A | 5/2009 |
| CN | 101501388 | A | 8/2009 |
| CN | 101641623 | | 3/2010 |
| CN | 102077011 | | 5/2011 |
| DE | 10251955 | | 5/2004 |
| DE | 102004051382 | | 4/2006 |
| DE | 102006061164 | | 6/2008 |
| DE | 10 2007 037862 | A1 | 10/2008 |
| DE | 202008013667 | | 12/2008 |
| DE | 102011004718 | | 8/2012 |
| EP | 0876085 | | 11/1998 |
| EP | 0876085 | A2 | 11/1998 |
| EP | 0890059 | A1 | 1/1999 |
| EP | 1058221 | A2 | 12/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 2345954 | A | 7/2000 |
| GB | 2 366 610 | A | 3/2002 |
| GB | 2366610 | | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H1177149 | | 7/1999 |
| JP | H11177149 | | 7/1999 |
| JP | 11-213730 | A | 8/1999 |
| JP | H11260125 | | 9/1999 |
| JP | 2000022222 | | 1/2000 |
| JP | 2000173304 | | 6/2000 |
| JP | 2001118403 | | 4/2001 |
| JP | 2002525814 | | 8/2002 |
| JP | 2003515899 | | 5/2003 |
| JP | 200507686 | | 8/2003 |
| JP | 2004146225 | | 5/2004 |
| JP | 2004241318 | | 8/2004 |
| JP | 2005-093097 | A | 4/2005 |
| JP | 2005108700 | | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2005021635 | | 11/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | 20064085 | | 9/2006 |
| JP | 2006525648 | | 11/2006 |
| JP | 2006331683 | | 12/2006 |
| JP | 2007049019 | | 2/2007 |
| JP | A2007049019 | | 2/2007 |
| JP | 200759930 | | 3/2007 |
| JP | 2007059911 | | 3/2007 |
| JP | 2007081090 | | 3/2007 |
| JP | 2007173397 | | 7/2007 |
| JP | 2007184330 | | 7/2007 |
| JP | 138653 | | 12/2007 |
| JP | 2008505448 | | 2/2008 |
| JP | 2008508742 | | 3/2008 |
| JP | 2008091140 | | 4/2008 |
| JP | 2008108835 | | 5/2008 |
| JP | 200815707 | | 7/2008 |
| JP | 2008523639 | | 7/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300460 | | 12/2008 |
| JP | 2008300570 | | 12/2008 |
| JP | 2009-016058 | A | 1/2009 |
| JP | 200916689 | | 1/2009 |
| JP | 2009016058 | | 1/2009 |
| JP | 2009016153 | | 1/2009 |
| JP | 2009021264 | | 1/2009 |
| JP | 2009059896 | | 3/2009 |
| JP | 2009117346 | | 5/2009 |
| JP | 200928435 | | 7/2009 |
| JP | U 3153766 | | 8/2009 |
| JP | 2009238960 | | 10/2009 |
| JP | 2009266780 | | 11/2009 |
| JP | 2009277586 | | 11/2009 |
| JP | 2009295299 | | 12/2009 |
| JP | WO 2009148543 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |
| JP | 2010237826 | | 11/2010 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | 200505054 | | 2/2005 |
| TW | 200527664 | | 8/2005 |
| TW | 200618339 | | 6/2006 |
| TW | 200619744 | | 6/2006 |
| TW | M309750 | | 4/2007 |
| TW | 200739151 | | 10/2007 |
| TW | 200806922 | | 1/2008 |
| TW | 200930937 | | 1/2009 |
| TW | 200938768 | | 1/2009 |
| TW | 200907239 | | 2/2009 |
| TW | 200943592 | | 10/2009 |
| TW | D134005 | | 3/2010 |
| TW | 100300960 | | 3/2011 |
| TW | D141681 | | 7/2011 |
| WO | WO 00/17569 | A1 | 3/2000 |
| WO | WO 0124583 | A1 | 4/2001 |
| WO | WO 01/40702 | A1 | 6/2001 |
| WO | WO 0160119 | A2 | 8/2001 |
| WO | 10251955 | A1 | 5/2004 |
| WO | WO 2004100213 | A2 | 5/2004 |
| WO | WO 2004068599 | | 8/2004 |
| WO | WO 2004100213 | | 11/2004 |
| WO | WO 2004100213 | A2 | 11/2004 |
| WO | WO 2005107420 | A2 | 11/2005 |
| WO | WO 2006012043 | | 2/2006 |
| WO | WO 2006065558 | | 6/2006 |
| WO | WO 2007/130358 | A2 | 11/2007 |
| WO | WO 2007146566 | A2 | 12/2007 |
| WO | WO 2008/018002 | A2 | 2/2008 |

(56) References Cited

FOREIGN PATENT DOCUMENTS

| | | | |
|---|---|---|---|
| WO | WO 2008018002 | | 2/2008 |
| WO | WO 2008134056 | A1 | 4/2008 |
| WO | WO 2008/052318 | A1 | 5/2008 |
| WO | WO 2008/117211 | A1 | 10/2008 |
| WO | WO 2008/146229 | A2 | 12/2008 |
| WO | WO 2008146229 | | 12/2008 |
| WO | WO 2009/024952 | A2 | 2/2009 |
| WO | WO 2009028861 | | 3/2009 |
| WO | WO 2009052099 | | 4/2009 |
| WO | WO 2009/091562 | A2 | 7/2009 |
| WO | WO 2009/093163 | A2 | 7/2009 |
| WO | WO 2009091562 | | 7/2009 |
| WO | WO 2009093163 | | 7/2009 |
| WO | WO 2009093163 | A2 | 7/2009 |
| WO | WO 2009/107052 | A1 | 9/2009 |
| WO | WO 2009107052 | | 9/2009 |
| WO | WO 2009/119038 | A2 | 10/2009 |
| WO | WO 2009/128004 | A1 | 10/2009 |
| WO | WO 2009119038 | | 10/2009 |
| WO | WO 2009125314 | A2 | 10/2009 |
| WO | WO 2009131627 | | 10/2009 |
| WO | WO 2009143047 | A2 | 11/2009 |
| WO | WO 2009/158422 | A1 | 12/2009 |
| WO | WO 2009158422 | | 12/2009 |
| WO | WO 2009158422 | A1 | 12/2009 |
| WO | WO 2010/012999 | A2 | 2/2010 |
| WO | WO 2010012999 | | 2/2010 |
| WO | WO 2010013893 | | 2/2010 |
| WO | WO 2010013898 | A2 | 2/2010 |
| WO | WO 2010052640 | | 5/2010 |
| WO | WO 2010/119618 | A1 | 10/2010 |
| WO | WO 2010/128419 | A1 | 11/2010 |
| WO | WO 2011100193 | | 8/2011 |
| WO | WO 2011109091 | A1 | 9/2011 |
| WO | WO2011109098 | | 9/2011 |
| WO | WO 2012011279 | | 1/2012 |
| WO | WO 2012031533 | | 3/2012 |

OTHER PUBLICATIONS

International Search Report and Written Opinion for counterpart PCT Application No. PCT/US2011/000402 mailed Sep. 30, 2011.
International Search Report and Written Opinion for PCT Patent Application No. PCT/US2011/000405 mailed Nov. 2, 2011.
International Search Report and Written Opinion for PCT/US2011/000407 mailed Nov. 16, 2011.
Office Action of the IPO for Taiwan Patent Application No. TW 100300962 issued Nov. 21, 2011.
Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.
International Search Report and Written Opinion for PCT/US2011/000400 mailed May 2, 2011.
CREE XLAMP® XP-G LED, Product Info and Data Sheet, 14 Pages.
CREE XLAMP® XP-E LED, Product Info and Data Sheet, 20 Pages.
Philips EnduraLED MR16 lamps, product information, 4 pages.
International Search Report and Written Opinion for PCT Application No. PCT/US2011/000397 mailed May 24, 2011.
International Search Report and Written Opinion for PCT Application No. PCT/US2010/003146 mailed Jun. 7, 2011.
Decision for Final Rejection for Japanese Patent Application No. 2001-542133 mailed Jun. 28, 2011.
International Search Report and Written Opinion for PCT/US2011/000403 mailed Aug. 23, 2011.
International Search Report and Written Opinion for PCT/US2011/000404 mailed Aug. 25, 2011.
International Search Report and Written Opinion for PCT/US2011/000398 mailed Aug. 30, 2011.
International Search Report and Written Opinion for PCT/US2011/000406 mailed Sep. 15, 2011.
International Search Report and Written Opinion from PCT Application No. PCT/US2012/044705 dated Oct. 9, 2012.
Notice to Submit a Response from Korean Patent Application No. 30-2011-0008446, dated Oct. 22, 2012.
Notice to Submit a Response from Korean Design Patent Application No. 30-2011-0024961, dated Sep. 10, 2012.
U.S. Appl. No. 11/656,759, filed Jan. 22, 2007, Chitnis.
U.S. Appl. No. 11/899,790, filed Sep. 7, 2007, Chitnis.
U.S. Appl. No. 11/473,089, filed Jun. 21, 2006, Tarsa.
U.S. Appl. No. 61/435,759, filed Jan. 24, 2011, Le.
U.S. Appl. No. 61/339,516, filed Mar. 3, 2010, Tong.
International Search Report and Written Opinion, PCT/US2009/063804, Mailed on Feb. 26, 2010.
U.S. Appl. No. 12/566,195, Van De Ven.
U.S. Appl. No. 12/704,730, Van De Ven.
C.Crane GEOBULB®—II LED Light Bulb, Item #2SW, Description, p. 1-2.
C.Crane GEOBULB®—II LED Light Bulb, Item #2SW, Specs, p. 1-2.
CREE LR4, 4" Recessed Architectural Downlight, Product Info p. 1-2.
CREE LR6, 6" Recessed Downlight Module, Product Info, p. 1-2.
U.S. Appl. No. 12/901,405, filed Oct. 8, 2010, Tong.
U.S. Appl. No. 61/339,515, filed Mar. 3, 2010, Tong.
U.S. Appl. No. 12/848,825, filed Aug. 2, 2010, Tong.
Notice to Submit a Response from Korean Patent Application No. 30-2011-0008448, dated Apr. 16, 2012.
Notice to Submit a Response from Korean Patent Application No. 30-2011-0008445, dated Apr. 16, 2012.
Notice to Submit a Response from Korean Patent Application No. 30-2011-0008446, dated Apr. 16, 2012.
Office Action for Taiwanese Patent Application No. 100300961, dated May 7, 2012.
Office Action from Taiwanese Patent Application No. 100300960, dated May 7, 2012.
International Search Report and Written Opinion for PCT Application No. PCT/US2011/000399 mailed Jul. 12, 2011.
Decision to Refuse a European Patent Application for EP 09 152 962.8 dated Jul. 6, 2011.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Search Report and Written Opinion from PCT Application No. PCT/US2012/072108, dated Feb. 27, 2013.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014
Office Action from U.S. Appl. No. 13/034.501, dated Jan. 23, 2014.
Office Action from U.S. Appl. No. 13/028,946, dated Jul. 16, 2012.
Response to OA from Patent Appl. No. 13/028,946, filed Oct. 8, 2012.
Office Action from U.S. Appl. No. 13/029,025, dated Jul. 16, 2013.
Office Action from U.S. Appl. No. 13/430,478, dated Jun. 18, 2013.
Office Action from U.S. Appl. No. 12/901,405, dated Jul. 1, 2013.
Office Action from U.S. Appl. No. 13/018,291, dated Oct. 10, 2012.
Response to OA from U.S. Appl. No. 13/018,291, filed Jan. 7, 2013.
Office Action from U.S. Appl. No. 13/022,490, dated Nov. 7, 2012.

(56) References Cited

OTHER PUBLICATIONS

Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.
Office Action from U.S. Appl. No. 13/028,946, dated Dec. 47, 2012.
Response to OA from U.S. Appl. No. 13/028,946, filed Jan. 29, 2013.
Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to OA from U.S. Appl. No. 12/848,825, filed Feb. 5, 2013.
Office Action from U.S. Appl. No. 13/029,005, dated Jun. 11, 2013.
Notice of Reasons for Rejection from Japanese Patent Appl. No. 2012-543086, dated Aug. 27, 2013.
Office Action from U.S. Appl. No. 13/022,490, dated Oct. 17, 2013.
Office Action from U.S. Appl. No. 11/149,999, dated May 13, 2013.
Response to OA from U.S. Appl. No. 11/149,999, filed Sep. 13, 2013.
Office Action from U.S. Appl. No. 13/358,901, dated Oct. 9, 2013.
Office Action from U.S. Appl. No. 13/028,863, dated Jul. 30, 2013.
Notice of Reasons for Rejection from Japanese Patent Appl. No. 2012-543086, dated Dec. 24, 2013.
Office Action from Japanese Patent Appl. No. 2012-556062, dated Dec. 20, 2013.
International Preliminary Report on Patentability and Written Opinion from PCT/US2012/044705 dated Jan. 7, 2014.
Decision of Dismissal of Amendment, Decision of Rejection from Japanese Patent Appl. No. 2011-231319. dated Oct. 15, 2013.
Office Action from Japanese Patent Appl. No. 2012-556053, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028,913, dated Nov. 4, 2013.
Office Action from Japanese Patent Appl. No. 2012-556064, dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029.068, dated Nov. 15, 2013.
Office Action from U.S. Appl. No. 13/029,025, dated Dec. 6, 2013.
Office Action from Japanese Patent Appl. No. 2012-556066, dated Mar. 14, 2014.
First Office Action from Chinese Patent Appl. No. 201080062056.X, dated Feb. 12, 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/430,478, dated Feb. 21, 2014.
Office Action from U.S. Appl. No. 13/358,901, dated Mar. 6, 2014.
Office Action from U.S. Appl. No. 13/018,291, dated Mar. 7, 2014.
Office Action from U.S. Appl. No. 13/029,025, dated Mar. 19, 2014.
Office Action from U.S. Appl. No. 13/029,063, dated Apr. 1, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
First Office Action from Chinese Patent Application No. 2011800207069. dated May 5, 2014.
First Office Action from Chinese Patent Application No. 201180022606, dated May 4, 2014.
First Office Action from Chinese Patent Appl. No. 201180020709.2, dated May 4, 2014.
Office Action from U.S. Appl. No. 13/028,946, dated May 27, 2014.
Office Action from U.S. Appl. No. 13/028,913, dated May 22, 2014.
First Office Action and Search Report from Chinese Patent Appl. No. 201180022620X. dated Jul. 1, 2014.
Office Action from U.S. Appl. No. 13/358,901, dated Jul. 15, 2014.
Response to OA from U.S. Appl. No. 13/358,901, filed Aug. 21, 2014.
Office Action from U.S. Appl. No. 13/340,478, dated Jul. 23, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/901,405, dated Aug. 7, 2014.
Second Office Action from Chinese Appl. No. 201080062056.X, dated Sep. 29, 2014.
First Office Action and Search Report from Chinese Appl. No. 2011800223856, dated Aug. 1, 2014.
Communication from European Appl. No. 12816621.2-1757, dated Sep. 25, 2014.
Pretrial Report from Japanese Patent Appl. No. 2011-231319, dated Apr. 14, 2014.
First Office Action from Chinese Patent Appl. No. 2011800223856, dated Aug. 1, 2014.
First Office Action from Chinese Patent Appl. No. 2011800226248, dated Aug. 25. 2014.
Official Action from European Patent Appl. No. 11710348.1-1757, dated Oct. 9, 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
Office Action from U.S. Appl. No. 13/029,068, dated Jun. 13, 2014.
Office Action from U.S. Appl. No. 13/018,245, dated Jun. 10, 2014.
Decision to Grant from Japanese Patent Appl. No. 2012-556066, dated Jul. 4, 2014.
Decision of Rejection from Japanese Patent Appl. No. 2012-556064, dated Jun. 6, 2014.
First Office Action from Chinese Appl. No. 201180022626.7, dated Nov. 15, 2014.
Second Office Action from Chinese Appl. No. 201180022606X, dated Dec. 23, 2014.
Appeal Decision from Japanese Appl. No. 2011-231319. dated Jan. 13, 2015.
Office Action from U.S. Appl. No. 13/607,300, dated Nov. 19, 2014.
Office Action from U.S. Appl. No. 13/029,025, dated Dec. 11, 2014.
Office Action from U.S. Appl. No. 13/018,245, dated Dec. 11, 2014.
Office Action from U.S. Appl. No. 13/029,068, dated Dec. 23, 2014.
Office Action from U.S. Appl. No. 13/029,068, dated Sep. 26, 2014.
Response to OA from U.S. Appl. No. 13/029,068, filed Nov. 18, 2014.
Office Action from U.S. Appl. No. 13/358,501, dated Oct. 31, 2014.
Office Action from U.S. Appl. No. 13/430,478, dated Nov. 5, 2014.
Office Action from U.S. Appl. No. 13/034,501, dated Nov. 5, 2014.
Office Action from U.S. Appl. No. 13/028,863, dated Nov. 10, 2014.
Decision to Grant from Japanese Appl. No. 2012-556062, dated Nov. 27, 2014.
Second Office Action from Chinese Patent Appl. No. 2011800207069, dated Dec. 5. 2014.
Summons to Oral Proceedings from European Patent Appl. No. 09152962/2166580, dated Jan. 29, 2015.
First Office Action from Chinese Patent Appl. No. 2011800225832, dated Jan. 20, 2015.

(56) References Cited

OTHER PUBLICATIONS

First Office Action from Chinese Patent Appl. No. 2011800226214, dated Dec. 25, 2014.
Office Action from Japanese Patent Appl. No. 2014-122643, dated Apr. 10, 2015.
Office Action and Search Report from Taiwanese Patent Appl. No. 100107051, dated May 12, 2015.
Office Action from U.S. Appl. No. 13/029,068, dated Mar. 31, 2015.
Office Action from U.S. Appl. No. 11/149,999, dated Mar. 31, 2015.
Office Action from U.S. Appl. No. 13/430,478, dated Apr. 22, 2015.
Office Action from U.S. Appl. No. 13/029,025, dated Apr. 29, 2015.
Office Action from U.S. Appl. No. 13/018,245, dated May 28, 2015.
Office Action from U.S. Appl. No. 13/028,863, dated Jun. 3, 2015.
Office Action from U.S. Appl. No. 13/758,763, dated Jun. 5, 2015.
Office Action from U.S. Appl. No. 14/185,123, dated Jun. 9, 2015.
Second Office Action and Search Report from Chinese Patent Appl. No. 2011800207092, dated Jan. 22, 2015.
Examination Report from European Patent Appl. No. 11 710 348.1-1757, dated Feb. 18, 2015.
Examination Report from European Patent Appl. No. 11 710 906.6-1757, dated Feb. 18, 2015.
Examination Report from European Patent Appl. No. 12 740 244.4-1757. dated Feb. 9, 2015.
Office Action from U.S. Appl. No. 13/029,063, dated Jan. 13, 2015.
Office Action from U.S. Appl. No. 14/014,272, dated Jan. 14, 2015.
Response to OA from U.S. Appl. No. 14/014,272, filed Mar. 3, 2015.
Office Action from U.S. Appl. No. 12/901,405, dated Feb. 4, 2015.
Examination from European Patent Appl. No. 107991390. dated Nov. 18, 2015.
Request for Correction from Chinese Patent Appl. No. 201180022606X. dated Nov. 12, 2015.
Third Office Action from Chinese Patent Appl. No. 2011800223856, dated Nov. 2, 2015.
Office Action from U.S. Appl. No. 13/536,707, dated Nov. 16, 2015.
Office Action from U.S. Appl. No. 14/185,123, dated Nov. 17, 2015.
Office Action from U.S. Appl. No. 13/029,068, dated Dec. 3, 2015.
Office Action from U.S. Appl. No. 14/453,482, dated Oct. 1, 2015.
Office Action from U.S. Appl. No. 14/108,815, dated Nov. 5, 2015.
Search Report and Office Action from Taiwanese Patent Appl. No. 099143627, dated Jun. 12. 2015.
Office Action from Taiwanese Patent Appl. No. 100107012, dated Jul. 22, 2015.
Decision of Board of Appeal and Minutes of Oral Proceedings from European Appl. No. 09152962. dated Jun. 2, 2015.
Decision to Grant from Chinese Patent Appl. No. 201080062056 X. dated Jul. 6, 2015.
Office Action from Taiwanese Appl. No. 101107038, dated Jul. 21, 2015.
Office Action from Taiwanese Patent Appl. No. 100107042, dated Jun. 2, 2015.
Office Action from Taiwanese Patent Appl. No. 100107047, dated Jun. 2, 2015.
Office Action from Taiwanese Patent Appl. No. 100107040, dated Jun. 2, 2015.
Office Action from Taiwanese Patent Appl. No. 100107044, dated Jun. 1, 2015.
Third Office Action from Chinese Patent Appl. No. 201180022606X, dated Jun. 10, 2015.
Third Office Action from Chinese Patent Appl. No. 2011800207092, dated Jul. 13, 2015.
Notice of Allowance from Japanese Patent Appl. No. 2014-122643, dated Sep. 3, 2015.
Notification of the Fourth Office Action from Chinese Patent Appl. No. 2011800207069, dated Aug. 24, 2015.
Decision of Rejection from Japanese Patent Appl. No. 2012-566065. dated Aug. 18, 2015.
Second Office Action from Chinese Patent Appl. No. 2011800226267. dated Aug. 3, 2015.
Office Action from U.S. Appl. No. 13/029,025, dated Aug. 17, 2015.
Office Action from U.S. Appl. No. 13/430,478, dated Aug. 27, 2015.
Office Action from U.S. Appl. No. 13/029,068, dated Sep. 8, 2015.
Office Action from U.S. Appl. No. 13/029,063, dated Sep. 17, 2015.
Office Action from U.S. Appl. No. 11/149,999, dated Oct. 1, 2015.
Third Office Action from Chinese Patent Appl. No. 2011800223856-translations only. original already submitted.
Official Notification and Search Report from Taiwanese Patent Appl. No. 10421609300. dated Dec. 1. 2015.
Official Notification and Search Report from Taiwanese Patent Appl. No 10421621560, dated Dec. 2, 2015.
Third Office Action from Chinese Patent Appl. No. 2011800226248. dated Nov. 20, 2015.
Official Notification and Search Report from Taiwanese Patent appl. No 10421651990. dated Dec. 7, 2015.
Notice of Issuance from Chinese Patent Appl. No. 2011800226063X, dated Dec. 10, 2015.
Official Notification and Search Report from Taiwanese Patent Appl. No. 10421595210. dated Nov. 27, 2015.
Office Action from Chinese Patent Appl. No. 201180022583.2. dated Dec. 17, 2015.
Examination from European Patent appl. No. 11 710 906.6-1757, dated Jan. 8, 2016.
Examination from European Patent appl. No. 11 710 348.1-1757. dated Jan. 8, 2016.
Office Action from U.S. Appl. No. 13/029,025; Jan. 6, 2016.
Office Action from U.S. Appl. No. 13/430,478; Jan. 7, 2016.
Office Action from U.S. Appl. No. 13/758,763; Feb. 2, 2016.
Office Action from U.S. Appl. No. 13/029,063; Feb. 11, 2016.
Third Office Action for Chinese Application No. 2011800226267; Dated Apr. 6, 2016.
Office Action from U.S. Appl. No. 14/108,815, Dated Apr. 27, 2016.
Fourth Office Action for Chinese Application No. 2011800223856 May 5, 2016.
Fourth Office Action for Chinese Application No. 201180022624.8: May 24, 2016.
Fourth Office Action for Chinese Application No. 2011800223837; Jun. 6, 2016.
Office Action from U.S. Appl. No. 13/029,068; Dated Jun. 9, 2016.
Office Action from U.S. Appl. No. 13/516,707; Dated Jun. 23, 2016.
Fourth Office Action from Chinese Patent Appl. No. 201180020709. 2, Dated Jan. 25, 2016.
Decision of Rejection from Chinese Patent Appl. No. 201180020706.9. dated Mar. 2, 2016.
Re-Examination Report from Japanese Patent Appl. No. 2012-556065. dated Feb. 1, 2016.
Examination Report from European Patent Appl. No. 11 709 509.1-1757. Dated Mar. 4, 2016.
Office Action from U.S. Appl. No. 13/430,478: Jan. 7, 2016.
Office Action from U.S. Appl. No. 13/758,763: Feb. 2, 2016
Office Action from U.S. Appl. No. 13/029,063: Feb. 11, 2016.
Office Action from U.S. Appl. No. 14/453,482: Apr. 1, 2016.
Third Office Action for Chinese Application No. 2011800225832; Dated Jul. 7, 2016.
Notice of Issuance for Chinese Application No. 201180020769.2; Dated Jul. 25, 2016.
Office Action for U.S. Appl. No. 13/758,763; Dated Jul. 26, 2016.
European Office Action for U.S. Appl. No. 11710348.1; Dated Aug. 8, 2016.
Office Action for U.S. Appl. No. 13/029,063; Dated Sep. 8, 2016.
Second Office Action from Chinese Patent Appl. No. 2011800223056, dated Apr. 16, 2015.
Office Action from Taiwanese Patent Appl. No. 100107048, dated Apr. 24, 2015.
Notice of Decline of Amendments and Final Office Action from Japanese Appl. No. 2012-556065, dated Apr. 10, 2015.
Second Office Action from Chinese Patent Appl. No. 2011600223837. dated Apr. 13. 2015.
Communication from European Patent Appl. No. 13762957.2-1757. dated Apr. 30, 2015.
Third Office Action from Chinese Patent Appl. No. 2011800207069, dated Apr. 13, 2015.
Second Office Action from Chinese Patent Appl. No. 2011800226248, dated May 4, 2015.

(56) References Cited

OTHER PUBLICATIONS

Office Action from Taiwanese Appl. No. 100107047. dated Jun. 5, 2015.
Second Office Action from Chinese Appl. No. 201180022620X. dated Apr. 20, 2015.
Office Action from Taiwanese Appl. No. 100107040, dated Jun. 5, 2015.
Office Action from Taiwanese Patent Appl. No. 10420724800, dated Jun. 2, 2015.
Office Action and Search Report from Taiwanese Patent Appl. No. 100107051, dated May 12. 2015.
Foreign Office Action for Japanese Appl. No. 2012-556065; Dated Nov. 22, 2016.
Foreign Office Action for Chinese Appl. No. 2011800207069; Dated Nov. 29, 2016.
Foreign Office Action for Chinese Appl. No. 201180022620; Dated Dec. 1, 2016.
Foreign Office Action for Chinese Appl. No. 2011800226267; Dated Dec. 15, 2016.
Notice of Allowance for Chinese Application No. 201180022624.8; Dated Jan. 3, 2017.
Office Action for U.S. Appl. No. 13/029,068; Dated Jan. 10, 2017.

* cited by examiner

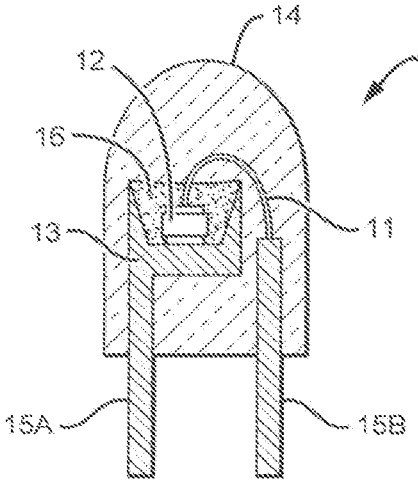
FIG. 1
PRIOR ART
FIG. 2
PRIOR ART
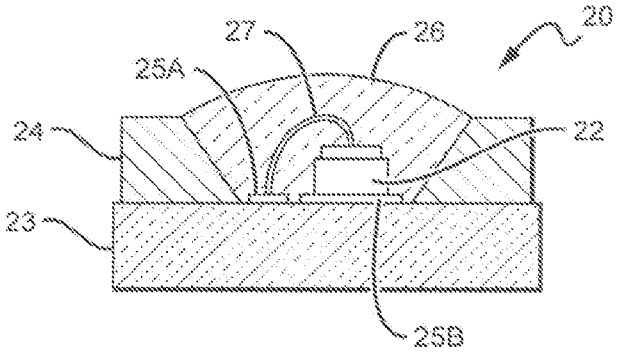
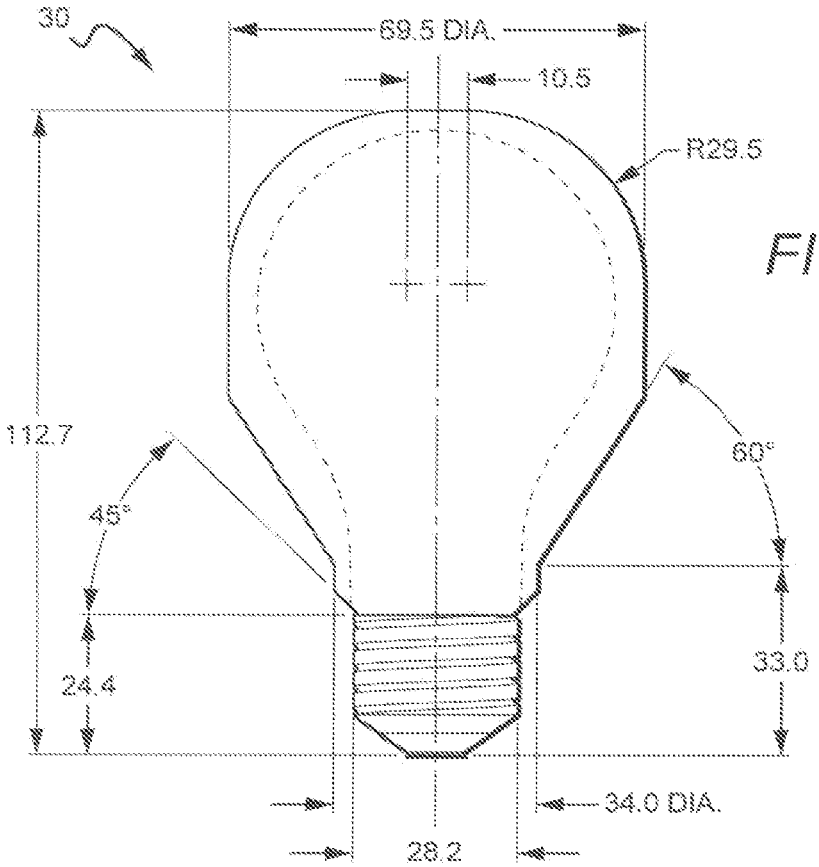
FIG. 3

FIG. 10
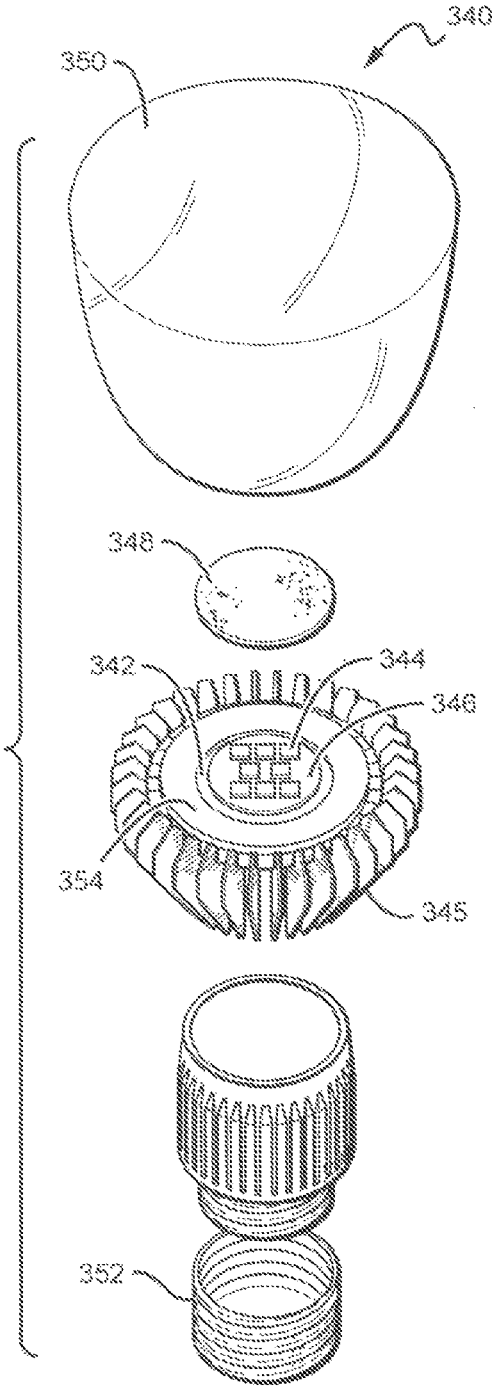
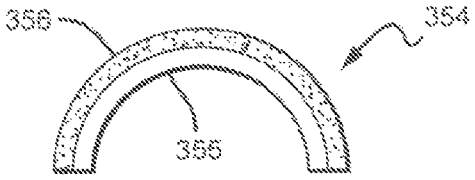
FIG. 11
FIG. 12
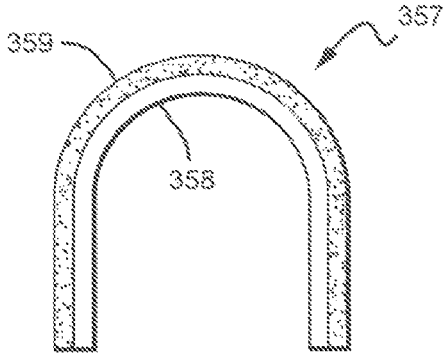
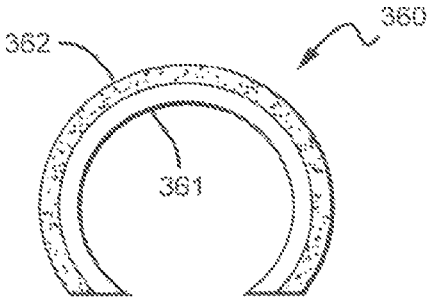
FIG. 13
FIG. 14
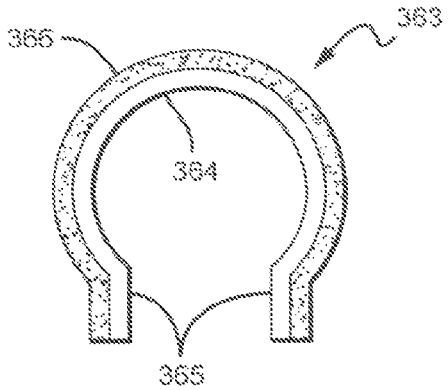

FIG. 18
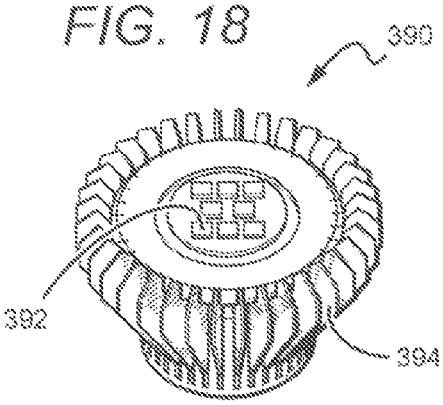
FIG. 19
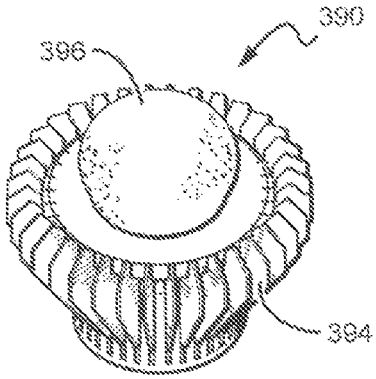
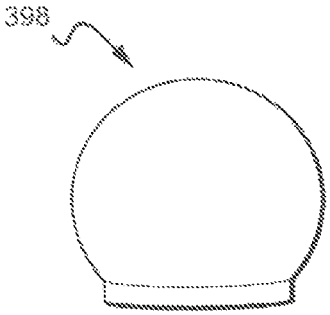
FIG. 20
FIG. 21
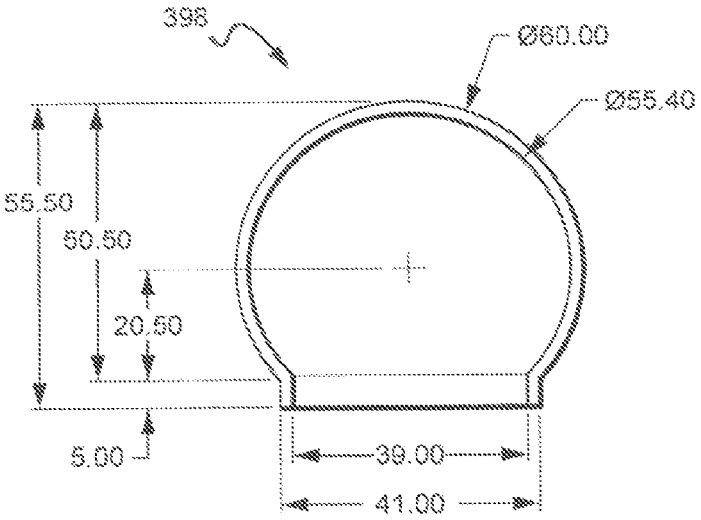

FIG. 25
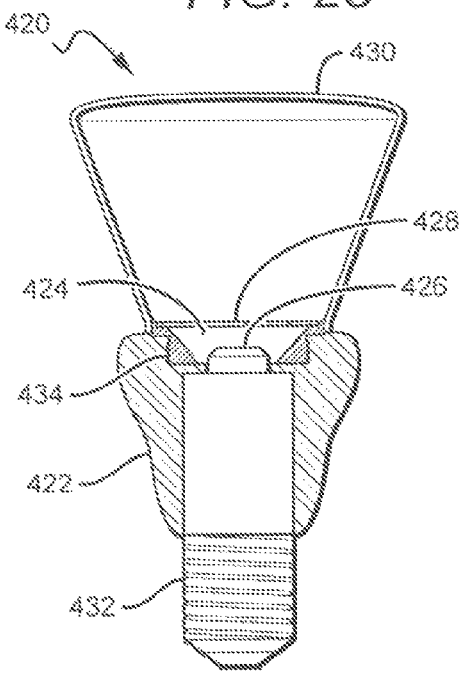
FIG. 26
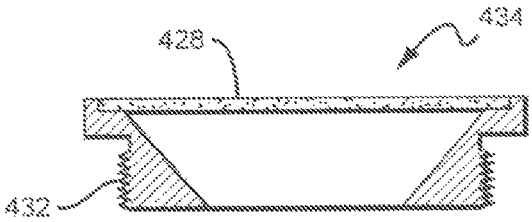
FIG. 27
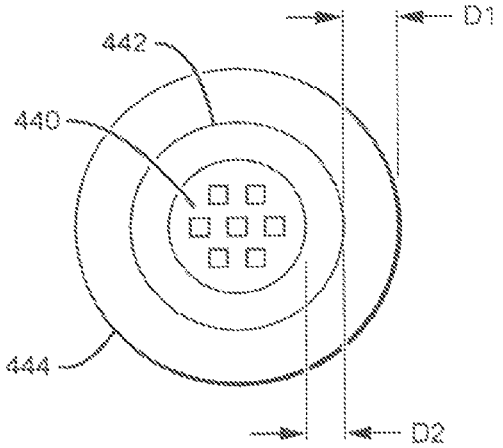
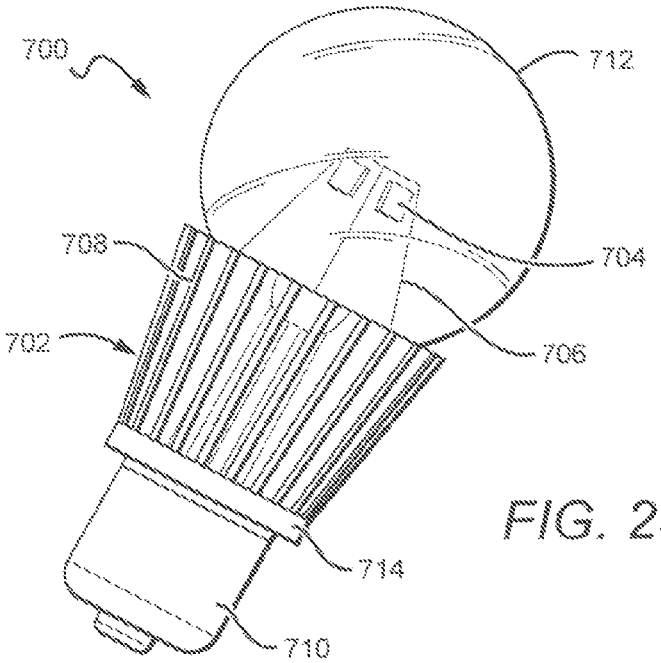
FIG. 28

FIG. 29
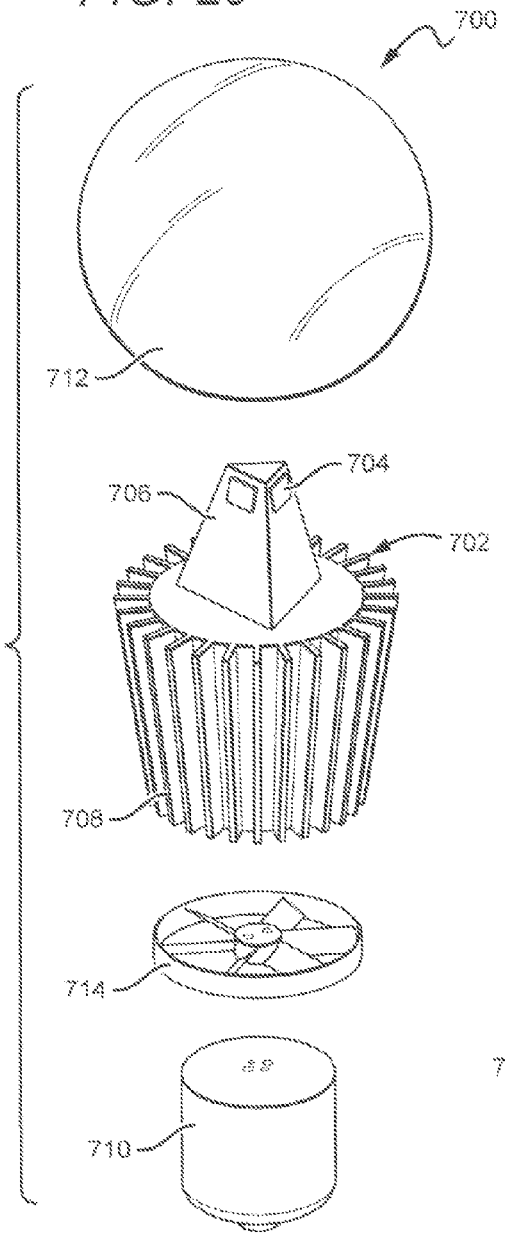
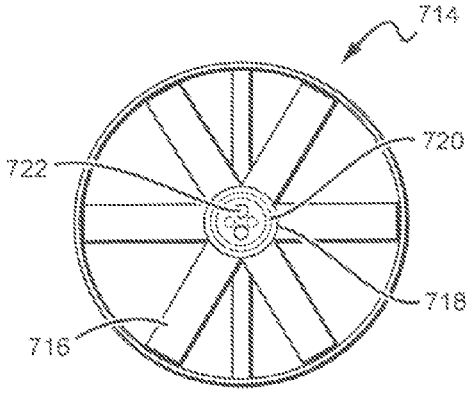
FIG. 30
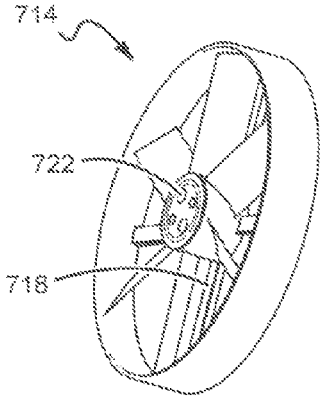
FIG. 31
FIG. 32
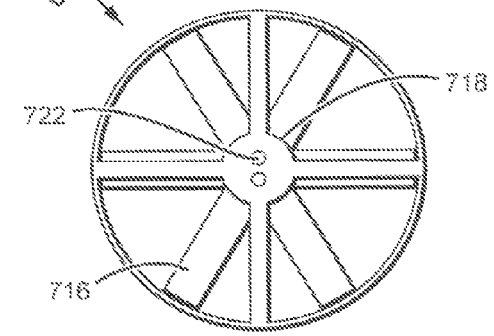

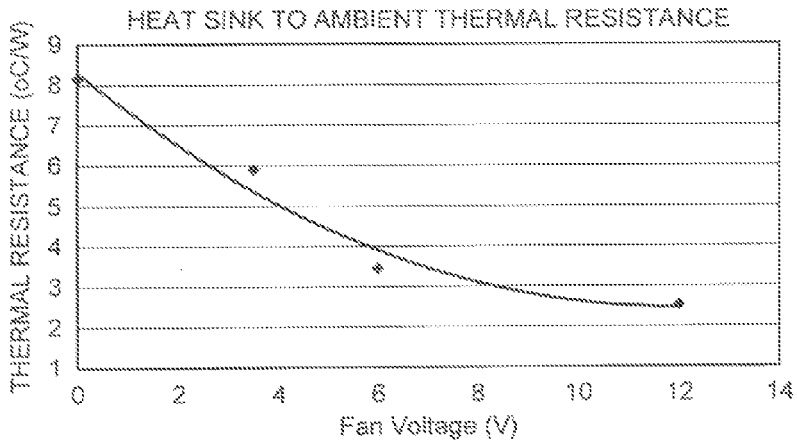
FIG. 33
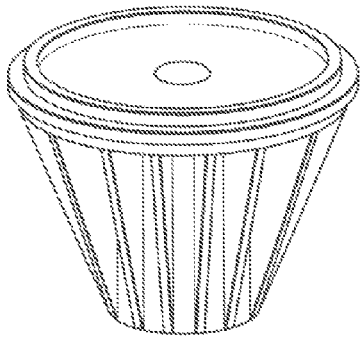
FIG. 36
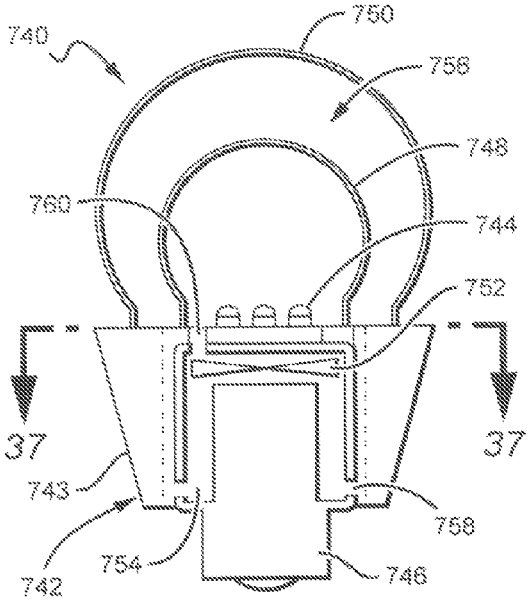
FIG. 37
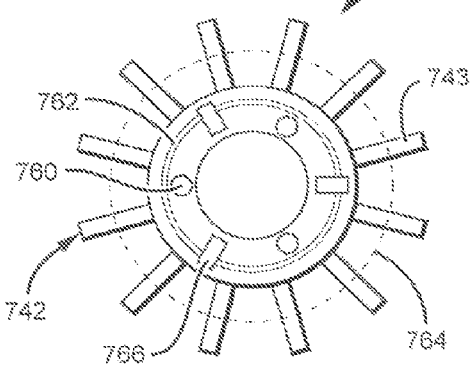

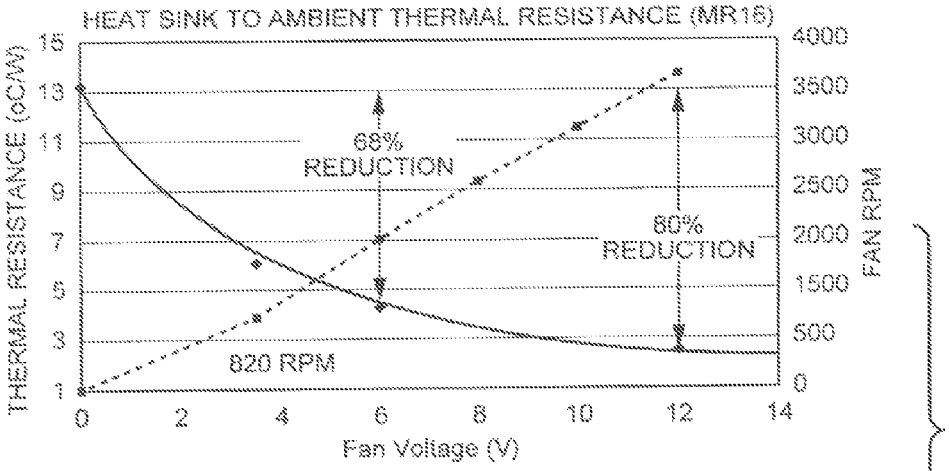
FIG. 34
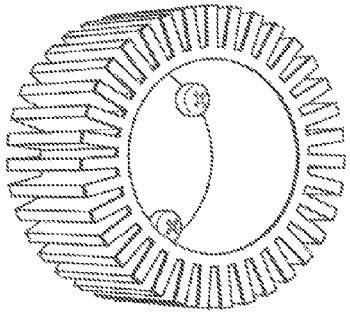
FIG. 38
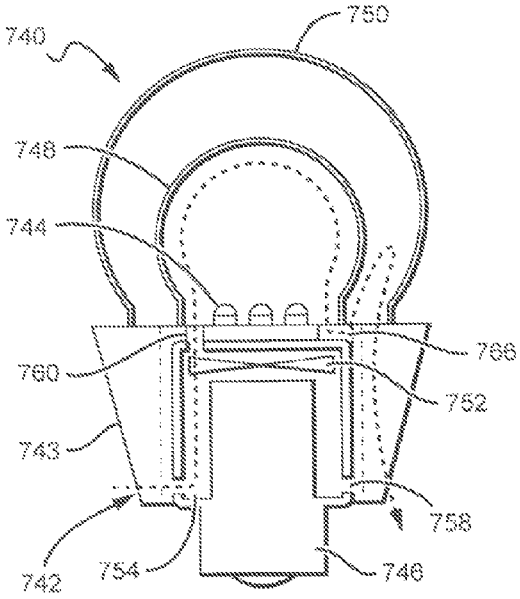
FIG. 39
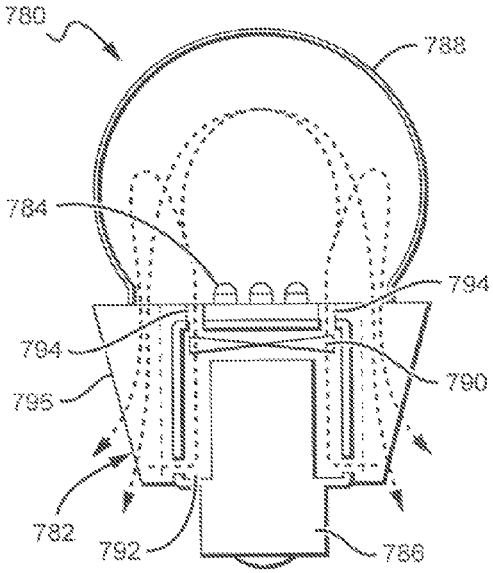

LED LAMP WITH ACTIVE COOLING ELEMENT

This application claims the benefit of U.S. Provisional Patent Application Ser. No. 61/339,516, filed on Mar. 3, 2010, U.S. Provisional Patent Application Ser. No. 61/339,515, filed on Mar. 3, 2010, U.S. Provisional Patent Application Ser. No. 61/386,437, filed on Sep. 24, 2010, U.S. Provisional Application Ser. No. 61/424,665, filed on Dec. 19, 2010, and U.S. Provisional Application Ser. No. 61/424,670, filed on Dec. 19, 2010. This application is also a continuation-in-part from, and claims the benefit of, U.S. patent application Ser. No. 12/848,825, filed on Aug. 2, 2010, U.S. patent application Ser. No. 12/889,719, filed on Sep. 24, 2010, and U.S. patent application Ser. No. 12/975,820, filed on Dec. 22, 2010.

BACKGROUND OF THE INVENTION

Field of the Invention

This invention relates to solid state lamps and bulbs and in particular to efficient and reliable light emitting diode (LED) based lamps having active elements to assist in dissipating heat from the lamps and bulbs during operation.

Description of the Related Art

Incandescent or filament-based lamps or bulbs are commonly used as light sources for both residential and commercial facilities. However, such lamps are highly inefficient light sources, with as much as 95% of the input energy lost, primarily in the form of heat or infrared energy. One common alternative to incandescent lamps, so-called compact fluorescent lamps (CFLs), are more effective at converting electricity into light but require the use of toxic materials which, along with its various compounds, can cause both chronic and acute poisoning and can lead to environmental pollution. One solution for improving the efficiency of lamps or bulbs is to use solid state devices such as light emitting diodes (LED or LEDs), rather than metal filaments, to produce light.

Light emitting diodes generally comprise one or more active layers of semiconductor material sandwiched between oppositely doped layers. When a bias is applied across the doped layers, holes and electrons are injected into the active layer where they recombine to generate light. Light is emitted from the active layer and from various surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflective cup due to the less than 100% reflectivity of practical reflector surfaces). In addition, heat retention may be an issue for a package such as the package 10 shown in FIG. 1*a*, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 27 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

LED chips which have a conversion material in close proximity or as a direct coating have been used in a variety of different packages, but experience some limitations based on the structure of the devices. When the phosphor material is on or in close proximity to the LED epitaxial layers (and in some instances comprises a conformal coat over the LED), the phosphor can be subjected directly to heat generated by the chip which can cause the temperature of the phosphor material to increase. Further, in such cases the phosphor can be subjected to very high concentrations or flux of incident light from the LED. Since the conversion process is in general not 100% efficient, excess heat is produced in the phosphor layer in proportion to the incident light flux. In compact phosphor layers close to the LED chip, this can lead to substantial temperature increases in the phosphor layer as large quantities of heat are generated in small areas. This temperature increase can be exacerbated when phosphor particles are embedded in low thermal conductivity material such as silicone which does not provide an effective dissipation path for the heat generated within the phosphor particles. Such elevated operating temperatures can cause degradation of the phosphor and surrounding materials over time, as well as a reduction in phosphor conversion efficiency and a shift in conversion color.

Lamps have also been developed utilizing solid state light sources, such as LEDs, in combination with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light to a different wavelength through a phosphor or other conversion material. In some embodiments the separator spaces the light source a sufficient distance from the disperser such that heat from the light source will not transfer to the disperser when the light source is carrying elevated currents necessary for room illumination. Additional remote phosphor techniques are described in U.S. Pat. No. 7,614,759 to Negley et al., entitled "Lighting Device."

One potential disadvantage of lamps incorporating remote phosphors is that they can have undesirable visual or aesthetic characteristics. When the lamps are not generating light the lamp can have a surface color that is different from the typical white or clear appearance of the standard Edison bulb. In some instances the lamp can have a yellow or orange appearance, primarily resulting from the phosphor conversion material. This appearance can be considered undesirable for many applications where it can cause aesthetic issues with the surrounding architectural elements when the light is not illuminated. This can have a negative impact on the overall consumer acceptance of these types of lamps.

Further, compared to conformal or adjacent phosphor arrangements where heat generated in the phosphor layer during the conversion process may be conducted or dissipated via the nearby chip or substrate surfaces, remote phosphor arrangements can be subject to inadequate thermally conductive heat dissipation paths. Without an effective heat dissipation pathway, thermally isolated remote phosphors may suffer from elevated operating temperatures that in some instances can be even higher than the temperature in comparable conformal coated layers. This can offset some or all of the benefit achieved by placing the phosphor remotely with respect to the chip. Stated differently, remote phosphor placement relative to the LED chip can reduce or eliminate direct heating of the phosphor layer due to heat generated within the LED chip during operation, but the resulting phosphor temperature decrease may be offset in part or entirely due to heat generated in the phosphor layer itself during the light conversion process and lack of a suitable thermal path to dissipate this generated heat.

Another issue affecting the implementation and acceptance of lamps utilizing solid state light sources relates to the nature of the light emitted by the light source itself. In order to fabricate efficient lamps or bulbs based on LED light sources (and associated conversion layers), it is typically desirable to place the LED chips or packages in a co-planar arrangement. This facilitates manufacture and can reduce manufacturing costs by allowing the use of conventional production equipment and processes. However, co-planar arrangements of LED chips typically produce a forward directed light intensity profile (e.g., a Lambertian profile). Such beam profiles are generally not desired in applications where the solid-state lamp or bulb is intended to replace a conventional lamp such as a traditional incandescent bulb, which has a much more omnidirectional beam pattern. While it is possible to mount the LED light sources or packages in a three-dimensional arrangement, such arrangements are generally difficult and expensive to fabricate.

As mentioned, lamps having LED chips with a conversion material in close proximity or as a direct coating have, as well as remote conversion materials can suffer from increased temperature, particularly at high current operation. The LED chips can also generate heat and can suffer from the detrimental effects of heat build-up. Lamps can comprise heat sinks to draw heat away from the LED chips and/or conversion material, but even these lamps can suffer from inadequate heat dissipation. Good heat dissipation with well controlled LED chip junction temperature presents a unique challenge for solid state lighting solutions in comparison with traditional incandescent and fluorescent lighting. Current lamp technologies almost exclusively use pure natural convection to dissipate the lamp. It is often the case that the convective heat dissipation into the ambient air can be the biggest thermal dissipation bottleneck of the luminaire system. This can be especially true for smaller luminaires with a limited form factor where the size of the heat sink is limited, such as with A-bulb replacement. The high convective thermal resistance results at least partially from weak natural convection where heat is carried away only by the buoyancy flow of the ambient air. The buoyancy flow is typically very slow, especially for small sized objects.

SUMMARY OF THE INVENTION

The present invention provides solid state lamps and bulbs that can operate with a significant reduction in convective thermal resistance without significantly increasing the size of the lamp or bulb or their power consumption. The different embodiments can be arranged to enhance the convective heat transfer around elements of the lamp by including active elements to disturb or agitate the air around these elements. The lamps according to the present invention can have many different components, including but not limited to different combinations and arrangements of a light source, one or more wavelength conversion materials, regions or layers which are positioned separately or remotely with respect to the light source, and a separate diffusing layer.

One embodiment of a solid state light source according to the present invention comprises a light emitting diode (LED) and a heat sink with the LED in thermal contact with the heat sink. The lamp further comprises an active agitation mechanism arranged to reduce the convective thermal resistance of at least some lamp elements. In some embodiments, the agitation mechanism can comprise an integral fan.

Another embodiment of a solid state light source according to the present invention comprises a plurality of light emitting diodes (LEDs) and a heat sink arranged in relation to the LEDs so that the LEDs are in thermal contact with the heat sink. An integral fan is arranged to flow air over the surfaces of the heat sink to reduce the convective thermal resistance of the heat sink.

Still another embodiment of a solid state light source according to the present invention comprises a plurality of LEDs and a heat sink arranged in relation to the LEDs so that the LEDs are in thermal contact with the heat sink. A fan is included that is internal to the lamp and arranged flow air over the surfaces of the lamp to reduce the convective thermal resistance at the surfaces.

Another embodiment of a solid state light source according to the present invention comprises a plurality of LEDs and a heat sink having a heat sink core. The LEDs are arranged on and in thermal contact with the heat sink. A fan is arranged within said heat sink core, and a base is included having drive electronics. The base is mounted to the heat sink and at least partially within the heat sink core. A diffuser dome is mounted on the heat sink over the LEDs, with the fan drawing air into the heat sink core and flowing air into the diffuser cavity.

These and other aspects and advantages of the invention will become apparent from the following detailed description and the accompanying drawings which illustrate by way of example the features of the invention.

BRIEF DESCRIPTION OF THE DRAWINGS

FIG. 1 shows a sectional view of one embodiment of a prior art LED lamp;

FIG. 2 shows a sectional view of another embodiment of a prior art LED lamp;

FIG. 3 shows the size specifications for an A19 replacement bulb;

FIG. 10 is an exploded view of the lamp shown in FIG. 8;

FIG. 11 is a sectional view of one embodiment of a three-dimensional phosphor carrier according to the present invention;

FIG. 12 is a sectional view of another embodiment of a three-dimensional phosphor carrier according to the present invention;

FIG. 13 is a sectional view of another embodiment of a three-dimensional phosphor carrier according to the present invention;

FIG. 14 is a sectional view of another embodiment of a three-dimensional phosphor carrier according to the present invention;

FIG. 18 is a perspective view of one embodiment of a lamp according to the present invention comprising a heat sink and light source;

FIG. 19 is a perspective view of the lamp in FIG. 42 with a dome shaped phosphor carrier;

FIG. 20 is a side view of one embodiment of a dome shaped diffuser according to the present invention;

FIG. 21 is a sectional view of the embodiment of dome shaped diffuser shown in FIG. 44 with dimensions;

FIG. 25 is a sectional view of another embodiment of a lamp according to the present invention;

FIG. 26 is a sectional view of one embodiment of a collar cavity according to the present invention;

FIG. 27 is a schematic showing the footprint of different feature of one embodiment of a lamp according to the present invention;

FIG. 28 is a perspective view of another embodiment of a lamp according to the present invention;

FIG. 29 is a perspective exploded view of the lamp shown in FIG. 28;

FIG. 30 is a bottom view of a fan that can be used in one embodiment of a lamp according to the present invention;

FIG. 31 is a perspective view of the fan shown in FIG. 30;

FIG. 32 is a top view of the fan shown in FIG. 30;

FIG. 33 is a graph showing thermal resistance in relation to voltage applied to a fan for a particular heat sink;

FIG. 34 is another graph showing thermal resistance in relation to voltage applied to a fan for another heat sink;

FIG. 36 is a sectional view on one embodiment of a lamp according to the present invention;

FIG. 37 is a sectional view of the lamp in FIG. 36 taken along section lines 37-37;

FIG. 38 is a sectional view of the lamp shown in FIG. 36 showing an air flow path through the lamp; and FIG. 39 is sectional view of still another embodiment of a lamp according to the present invention.

DETAILED DESCRIPTION OF THE INVENTION

Figure 4:
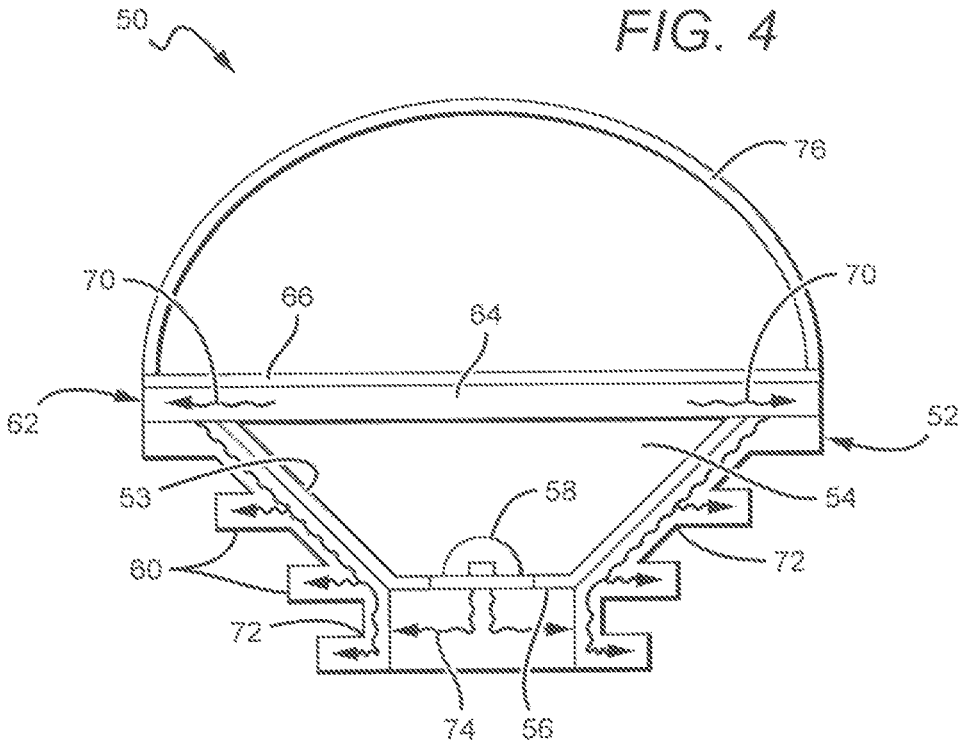
FIG. 4 is a sectional view of one embodiment of a lamp according to the present invention.

The present invention is directed to improved solid state lamp or bulb structures that are efficient, reliable and cost effective. In some embodiments, the lamps according to the present invention can provide an essentially omnidirectional emission pattern from solid state light sources, while still having features that allow the lamps and their light sources to operate at reasonable temperatures. Some lamps can have light sources that comprise directional emitting light sources, such as forward emitting light sources, with the lamps including features to disperse the directional light source to a more uniform emission suitable for lamps. To allow operation at acceptable temperatures, the lamp structures can comprise active elements to assist in thermal management of the lamp structures and to reduce the convective thermal resistance around certain of the lamp elements. Reducing thermal resistance can increase the natural heat convection away from the lamp.

Some embodiments comprise LED based lamps or LED based A-bulb replacements that include a heat sink to draw heat away from the LED chips or conversion material. Some embodiments can comprise heat sinks with fins, but it is understood that different embodiments can have heat sinks without fins. It is also understood that other lamps can be provided without heat sinks, with the active thermal management elements allowing for operation at reasonable temperature without the assistance of a heat sink. For example, the active element, such as a fan, could be within a housing, and the active element can direct flow of ambient through holes and/or channels in and/or within the housing where the holes and/or channels are made in a poor thermally conductive material, such as a plastic.

It is also understood that heat sinks can be included in different locations within the lamp, such as fully or partially within the lamp housing, optical cavity or in the threaded screw portion. The active elements can be arranged to move or agitate air internal or external to the lamp elements to assist in reducing thermal resistance. It is further understood that portions of the lamp such as the housing, threaded screw portion, and portions of the optical cavity, can comprise plastic or insulating materials, with the active elements assisting in thermal dissipation from these elements with or without the assistance of thermally conductive material such as a heat sink.

In some embodiments having a heat sink, the convective thermal resistance can measure greater than 8° C./W when measured as a bare heat sink, and this can increase to greater than 10° C./W when the heat sink is integrated into a lamp or bulb. This relatively high convective thermal resistance can result from the weak natural convection where heat is carried away by the buoyancy flow of the ambient air. The buoyancy flow of air is typically very slow, especially for small geometries like typical lamps or bulbs. The heat sink convective thermal resistance can be much larger than the LED junction to heat sink conductive thermal resistance, and as a result, can be the most significant bottleneck of the system thermal pathway.

The present invention can comprise many different mechanisms to reduce convective thermal resistance and to reduce this bottleneck, such as mechanisms to move or agitate the air around elements of the lamp. In some embodiments, an integral fan element can be included in the lamp or bulb to provide air agitation or forced convection over portions of the lamp. Other mechanisms can be used to move or agitate the air, including but not limited to a vibrating diaphragm or jet induced flow. In still other embodiments, these devices can be used to move other cooling matters or materials over elements of the lamp to reduce thermal resistance.

Even relatively small amounts of air blown over portions of the lamp or bulb can markedly reduce the system convective thermal resistance. This can result in lower junction temperature of the LEDs and that of phosphor materials, leading to better luminous efficiency of the system and better reliability. A better thermal system can also allow the LEDs to be driven at higher current, thereby reducing the LED cost per lumen output. While pure natural convection in air typically provides a convective heat transfer coefficient of approximately 5 $W/m^2$-K, forced convection can increase the coefficient by one or even two orders of magnitude.

The fans used in the lamps according to the present invention should have a long lifetime, should consume a minimal amount of power, and should be as quiet as possible. In addition, the fans can be provided as part of a lamp that is modular in design. That is, if the fan or drive electronics fail before other components of the lamp, they can be easily removed and replaced.

The fans can be provided as part of the lamp in many different locations to provide airflow over different portions of the lamp. In some embodiments, the fan can be arranged to provide airflow over the heat sink to agitate the air around the heat sink. In those lamp embodiments where the heat sink has fins, the air from the fans can be arranged to agitate or break stagnant air that can build-up between the fins. This can be particularly important in embodiments having a small form factor with small space between adjacent fins. The implementation of a fan can provide the additional advantage of allowing for more heat sink fins with smaller spaces between adjacent fins.

In other embodiments, the fans can be integral to the lamp such that ambient air is drawn into internal spaces within the lamp, including internal to the heat sink or lamp bulb. In these embodiments, an air passage can be provided that allows air into the lamp, and also to allow air from within the bulb to pass out of the bulb. These fan arrangements provide a stream of air passing from outside the bulb, into the bulb and then out again. This can result in air flowing through the bulb agitating the air therein and thereby reducing thermal resistance over elements of the lamp. In some embodiments, the air can flow over the LEDs internal to the bulb, thereby reducing thermal resistance over the LEDs. This can also allow the LEDs to operate at a lower temperature. In different embodiments having a heat sink, air can also flow over the heat sink as it is drawn into the bulb, and/or as it flows out of the bulb. The air flow can also pass over other components, such as drive electronics.

The fans can be included in many different lamps, but are particularly applicable to solid state emitters with remote conversion materials (or phosphors) and remote diffusing elements or diffuser. In some embodiments, the diffuser not only serves to mask the phosphor from the view by the lamp user, but can also disperse or redistribute the light from the remote phosphor and/or the lamp's light source into a desired emission pattern. In some of these embodiments the diffuser dome can be arranged to disperse forward directed emission pattern into a more omnidirectional pattern useful for general lighting applications. The diffuser can be used in embodiments having two-dimensional as well as three-dimensional shaped remote conversion materials, such as globe or dome shaped. This combination of features provides the capability of transforming forward directed emission from an LED light source into a beam profile comparable with standard incandescent bulbs.

In some of these lamp embodiments, air inlets and outlets can be provided to allow air in and out of the space within the diffuser and/or the remote phosphor. The active elements can provide improved thermal arrangement by being positioned relative to an inlet(s) to the inner volume of a diffuser and/or phosphor to move or agitate air within the volumes. One or more outlets can be spaced from the inlets to allow an air path out of the diffuser and/or conversion material volumes. In different embodiments, inlet(s) and outlet(s) can be arranged such that the air path passes over different lamp elements, such as the LEDs, driver circuitry, prior to passing out of the outlet(s). In lamps having a diffuser dome and a conversion material dome, the air path can be through both before passing out. In other embodiments it can be over the driver circuitry and heat sink before going into the volume between the diffuser and the conversion material dome, after which it passes out through the outlet(s). In some lamps there could be different inlet outlets for each dome. The outlets can be positioned relative to the heat sink or the heat sink could be in any part of the air path when passing in and/or out.

The present invention is described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

Some embodiments of lamps can have a dome-shaped (or frusto-spherical shaped) three dimensional conversion material over and spaced apart from the light source, and a dome-shaped diffuser spaced apart from and over the conversion material, such that the lamp exhibits a double-dome structure. The spaces between the various structures can comprise light mixing chambers that can promote not only dispersion of, but also color uniformity of the lamp emission. The space between the light source and conversion material, as well as the space between the conversion material, can serve as light mixing chambers. Other embodiments can comprise additional conversion materials or diffusers that can form additional mixing chambers. The order of the dome conversion materials and dome shaped diffusers can be different such that some embodiments can have a diffuser inside a conversion material, with the spaces between forming light mixing chambers. These are only a few of the many different conversion materials and diffuser arrangements according to the present invention.

Some lamp embodiments according to the present invention can comprise a light source having a co-planar arrangement of one or more LED chips or packages, with the emitters being mounted on a flat or planar surface. In other embodiments, the LED chips can be non co-planar, such as being on a pedestal or other three-dimensional structure. Co-planar light sources can reduce the complexity of the emitter arrangement, making them both easier and cheaper to manufacture. Co-planar light sources, however, tend to emit primarily in the forward direction such as in a Lambertian emission pattern. In different embodiments it can be desirable to emit a light pattern mimicking that of conventional incandescent light bulbs that can provide a near uniform emission intensity and color uniformity at different emission angles. Different embodiments of the present invention can comprise features that can transform the emission pattern from the non-uniform to substantially uniform within a range of viewing angles.

In some embodiments, a conversion layer or region that can comprise a phosphor carrier that can comprise a thermally conductive material that is at least partially transparent to light from the light source, and at least one phosphor material each of which absorbs light from the light source and emits a different wavelength of light. The diffuser can comprise a scattering film/particles and associated carrier such as a glass enclosure, and can serve to scatter or re-direct at least some of the light emitted by the light source and/or phosphor carrier to provide a desired beam profile. In some embodiments the lamps according to the present invention can emit a beam profile compatible with standard incandescent bulbs.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. By masking the phosphor carrier and other internal lamp features the diffuser that provides a desired overall lamp appearance when the lamp or bulb is not illuminated.

As mentioned, a heat sink or heat sink structure can be included which can be in thermal contact with the light source and with the phosphor carrier in order to dissipate heat generated within the light source and phosphor layer into the surrounding ambient. Electronic circuits may also be included to provide electrical power to the light source and other capabilities such as dimming, etc., and the circuits may include a means by which to apply power to the lamp, such as an Edison socket, etc.

Different embodiments of the lamps can have many different shapes and sizes, with some embodiments having dimensions to fit into standard size envelopes, such as the A19 size envelope 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23.

In some embodiments the light sources can comprise solid state light sources, such as different types of LEDs, LED chips or LED packages. In some embodiments a single LED chip or package can be used, while in others multiple LED chips or packages can be used arranged in different types of arrays. By having the phosphor thermally isolated from LED chips and with good thermal dissipation, the LED chips can be driven by higher current levels without causing detrimental effects to the conversion efficiency of the phosphor and its long term reliability. This can allow for the flexibility to overdrive the LED chips to lower the number of LEDs needed to produce the desired luminous flux. This in turn can reduce the cost on complexity of the lamps. These LED packages can comprise LEDs encapsulated with a material that can withstand the elevated luminous flux or can comprise unencapsulated LEDs.

In some embodiments the light source can comprise one or more blue emitting LEDs and the phosphor layer in the phosphor carrier can comprise one or more materials that absorb a portion of the blue light and emit one or more different wavelengths of light such that the lamp emits a white light combination from the blue LED and the conversion material. The conversion material can absorb the blue LED light and emit different colors of light including but not limited to yellow and green. The light source can also comprise different LEDs and conversion materials emitting different colors of light so that the lamp emits light with the desired characteristics such as color temperature and color rendering.

Conventional lamps incorporating both red and blue LEDs chips can be subject to color instability with different operating temperatures and dimming. This can be due to the different behaviors of red and blue LEDs at different temperature and operating power (current/voltage), as well as different operating characteristics over time. This effect can be mitigated somewhat through the implementation of an active control system that can add cost and complexity to the overall lamp. Different embodiments according to the present invention can address this issue by having a light source with the same type of emitters in combination with a remote phosphor carrier that can comprise multiple layers of phosphors that remain relatively cool through the thermal dissipation arrangements disclosed herein. In some embodiments, the remote phosphor carrier can absorb light from the emitters and can re-emit different colors of light, while still experiencing the efficiency and reliability of reduced operating temperature for the phosphors.

The separation of the phosphor elements from the LEDs provides that added advantage of easier and more consistent color binning. This can be achieved in a number of ways. LEDs from various bins (e.g. blue LEDs from various bins) can be assembled together to achieve substantially wavelength uniform excitation sources that can be used in different lamps. These can then be combined with phosphor carriers having substantially the same conversion characteristics to provide lamps emitting light within the desired bin. In addition, numerous phosphor carriers can be manufactured and pre-binned according to their different conversion characteristics. Different phosphor carriers can be combined with light sources emitting different characteristics to provide a lamp emitting light within a target color bin.

Some lamps according to the present invention can also provide for improved emission efficiency by surrounding the light source by a reflective surface. This results in enhanced photon recycling by reflecting much of the light re-emitted from the conversion material back toward the light source. To further enhance efficiency and to provide the desired emission profile, the surfaces of the phosphor layer, carrier layer or diffuser can be smooth or scattering. In some embodiments, the internal surfaces of the carrier layer and diffuser can be optically smooth to promote total internal reflecting behavior that reduces the amount of light directed backward from the phosphor layer (either downconverted light or scattered light). This reduces the amount of backward emitted light that can be absorbed by the lamp's LED chips, associated substrate, or other non-ideal reflecting surfaces within the interior of the lamp.

The present invention is described herein with reference to certain embodiments, but it is understood that the invention can be embodied in many different forms and should not be construed as limited to the embodiments set forth herein. In particular, the present invention is described below in regards to certain lamps having one or multiple LEDs or LED chips or LED packages in different configurations, but it is understood that the present invention can be used for many other lamps having many different configurations. The embodiments below are described with reference to LED of LEDs, but it is understood that this is meant to encompass LED chips and LED packages. The components can have different shapes and sizes beyond those shown and different numbers of LEDs can be included. It is also understood that the embodiments described below are utilize co-planar light sources, but it is understood that non co-planar light sources can also be used. It is also understood that the lamp's LED light source may be comprised of one or multiple LEDs, and in embodiments with more than one LED, the LEDs may have different emission wavelengths. Similarly, some LEDs may have adjacent or contacting phosphor layers or regions, while others may have either adjacent phosphor layers of different composition or no phosphor layer at all.

The present invention is described herein with reference to conversion materials, phosphor layers and phosphor carriers and diffusers being remote to one another. Remote in this context refers being spaced apart from and/or to not being on or in direct thermal contact.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIG. 4 shows one embodiment of a lamp 50 according to the present invention that comprises a heat sink structure 52 having an optical cavity 54 with a platform 56 for holding a light source 58. Although this embodiment and some embodiments below are described with reference to an optical cavity, it is understood that many other embodiments can be provided without optical cavities. These can include, but are not limited to, light sources being on a planar surface of the lamp structure or on a pedestal. The light source 58 can comprise many different emitters with the embodiment shown comprising an LED. Many different commercially available LED chips or LED packages can be used including but not limited to those commercially available from Cree, Inc. located in Durham, N.C. It is understood that lamp embodiments can be provided without an optical cavity, with the LEDs mounted in different ways in these other embodiments. By way of example, the light source can be mounted to a planar surface in the lamp or a pedestal can be provided for holding the LEDs.

The light source 58 can be mounted to the platform using many different known mounting methods and materials with light from the light source 58 emitting out the top opening of the cavity 54. In some embodiments light source 58 can be mounted directly to the platform 56, while in other embodiments the light source can be included on a submount or printed circuit board (PCB) that is then mounted to the platform 56. The platform 56 and the heat sink structure 52 can comprise electrically conductive paths for applying an electrical signal to the light source 58, with some of the conductive paths being conductive traces or wires. Portions of the platform 56 can also be made of a thermally conductive material and in some embodiments heat generated during operation aan spread to the platform and then to the heat sink structure.

The heat sink structure 52 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k. The heat sink structure 52 can also comprise other heat dissipation features such as heat fins 60 that increase the surface area of the heat sink to facilitate more efficient dissipation into the ambient. In some embodiments, the heat fins 60 can be made of material with higher thermal conductivity than the remainder of the heat sink. In the embodiment shown the fins 60 are shown in a generally horizontal orientation, but it is understood that in other embodiments the fins can have a vertical or angled orientation. In still other embodiments, the heat sink can comprise active cooling elements, such as fans, to lower the convective thermal resistance within the lamp. In some embodiments, heat dissipation from the phosphor carrier is achieved through a combination of convection thermal dissipation and conduction through the heat sink structure 52. Different heat dissipation arrangements and structures are described in U.S. Provisional Patent Application Ser. No. 61/339,516, to Tong et al., filed on Mar. 3, 2010, entitled "LED Lamp Incorporating Remote Phosphor with Heat Dissipation Features," also assigned to Cree, Inc. This application is incorporated herein by reference.

Reflective layers 53 can also be included on the heat sink structure 52, such as on the surface of the optical cavity 54. In those embodiments not having an optical cavity the reflective layers can be included around the light source. In some embodiments the surfaces can be coated with a material having a reflectivity of approximately 75% or more to the lamp visible wavelengths of light emitted by the light source 58 and/or wavelength conversion material ("the lamp light"), while in other embodiments the material can have a reflectivity of approximately 85% or more to the lamp light. In still other embodiments the material can have a reflectivity to the lamp light of approximately 95% or more.

The heat sink structure 52 can also comprise features for connecting to a source of electricity such as to different electrical receptacles. In some embodiments the heat sink structure can comprise a feature of the type to fit in conventional electrical receptacles. For example, it can include a feature for mounting to a standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the lamp 50. The lamps according to the present invention can comprise a power supply or power conversion unit that can comprise a driver to allow the bulb to run from an AC line voltage/current and to provide light source dimming capabilities. In some embodiments, the power supply can comprise an offline constant-current LED driver using a non-isolated quasi-resonant flyback topology. The LED driver can fit within the lamp and in some embodiments can comprise a less than 25 cubic centimeter volume, while in other embodiments it can comprise an approximately 20 cubic centimeter volume. In some embodiments the power supply can be non-dimmable but is low cost. It is understood that the power supply used can have different topology or geometry and can be dimmable as well.

A phosphor carrier 62 is included over the top opening of the cavity 54 and a dome shaped diffuser 76 is included over the phosphor carrier 62. In the embodiment shown phosphor carrier covers the entire opening and the cavity opening is shown as circular and the phosphor carrier 62 is a circular disk. It is understood that the cavity opening and the phosphor carrier can be many different shapes and sizes. It is also understood that the phosphor carrier 62 can cover less than all of the cavity opening. As further described below, the diffuser 76 is arranged to disperse the light from the phosphor carrier and/or LED into the desired lamp emission pattern and can comprise many different shapes and sizes depending on the light it receives from and the desired lamp emission pattern.

Embodiments of phosphor carriers according to the present invention can be characterized as comprising a conversion material and thermally conductive light transmitting material, but it is understood that phosphor carriers can also be provided that are not thermally conductive. The light transmitting material can be transparent to the light emitted from the light source 54 and the conversion material should be of the type that absorbs the wavelength of light from the light source and re-emits a different wavelength of light. In the embodiment shown, the thermally conductive light transmitting material comprises a carrier layer 64 and the conversion material comprises a phosphor layer 66 on the phosphor carrier. As further described below, different embodiments can comprise many different arrangements of the thermally conductive light transmitting material and the conversion material.

When light from the light source 58 is absorbed by the phosphor in the phosphor layer 66 it is re-emitted in isotropic directions with approximately 50% of the light emitting forward and 50% emitting backward into the cavity 54. In prior LEDs having conformal phosphor layers, a significant portion of the light emitted backwards can be directed back into the LED and its likelihood of escaping is limited by the extraction efficiency of the LED structure. For some LEDs the extraction efficiency can be approximately 70%, so a percentage of the light directed from the conversion material back into the LED can be lost. In the lamps according to the present invention having the remote phosphor configuration with LEDs on the platform 56 at the bottom of the cavity 54 a higher percentage of the backward phosphor light strikes a surface of the cavity instead of the LED. Coating these services with a reflective layer 53 increases the percentage of light that reflects back into the phosphor layer 66 where it can emit from the lamp. These reflective layers 53 allow for the optical cavity to effectively recycle photons, and increase the emission efficiency of the lamp. It is understood that the reflective layer can comprise many different materials and structures including but not limited to reflective metals or multiple layer reflective structures such as distributed Bragg reflectors. Reflective layers can also be included around the LEDs in those embodiments not having an optical cavity.

The carrier layer 64 can be made of many different materials having a thermal conductivity of 0.5 W/m-k or more, such as quartz, silicon carbide (SiC) (thermal conductivity ~120 W/m-k), glass (thermal conductivity of 1.0-1.4 W/m-k) or sapphire (thermal conductivity of ~40 W/m-k). In other embodiments, the carrier layer 64 can have thermal conductivity greater than 1.0 W/m-k, while in other embodiments it can have thermal conductivity of greater than 5.0 W/m-k. In still other embodiments it can have a thermal conductivity of greater that 10 W/m-k. In some embodiments the carrier layer can have thermal conductivity ranging from 1.4 to 10 W/m-k. The phosphor carrier can also have different thicknesses depending on the material being used, with a suitable range of thicknesses being 0.1 mm to 10 mm or more. It is understood that other thicknesses can also be used depending on the characteristics of the material for the carrier layer. The material should be thick enough to provide sufficient lateral heat spreading for the particular operating conditions. Generally, the higher the thermal conductivity of the material, the thinner the material can be while still providing the necessary thermal dissipation. Different factors can impact which carrier layer material is used including but not limited to cost and transparency to the light source light. Some materials may also be more suitable for larger diameters, such as glass or quartz. These can provide reduced manufacturing costs by formation of the phosphor layer on the larger diameter carrier layers and then singulation into the smaller carrier layers.

Many different phosphors can be used in the phosphor layer 66 with the present invention being particularly adapted to lamps emitting white light. As described above, in some embodiments the light source 58 can be LED based and can emit light in the blue wavelength spectrum. The phosphor layer can absorb some of the blue light and re-emit yellow. This allows the lamp to emit a white light combination of blue and yellow light. In some embodiments, the blue LED light can be converted by a yellow conversion material using a commercially available YAG:Ce phosphor, although a full range of broad yellow spectral emission is possible using conversion particles made of phosphors based on the $(Gd,Y)_3(Al,Ga)_5O_{12}$:Ce system, such as the $Y_3Al_5O_{12}$:Ce (YAG). Other yellow phosphors that can be used for creating white light when used with a blue emitting LED based emitter include but not limited to:

$Tb_3,RE_xO_{12}$:Ce(TAG); RE=Y, Gd, La, Lu; or $Sr_{2-x-y}Ba_xCa_ySiO_4$:Eu.

The phosphor layer can also be arranged with more than one phosphor either mixed in with the phosphor layer 66 or as a second phosphor layer on the carrier layer 64. In some embodiments, each of the two phosphors can absorb the LED light and can re-emit different colors of light. In these embodiments, the colors from the two phosphor layers can be combined for higher CRI white of different white hue (warm white). This can include light from yellow phosphors above that can be combined with light from red phosphors. Different red phosphors can be used including:

$Sr_xCa_{1-x}S$:Eu, Y; Y=halide;

$CaSiAlN_3$:Eu; or $Sr_{2-y}Ca_ySiO_4$:Eu

Other phosphors can be used to create color emission by converting substantially all light to a particular color. For example, the following phosphors can be used to generate green light:

$SrGa_2S_4$:Eu;

$Sr_{2-y}Ba_ySiO_4$:Eu; or $SrSi_2O_2N_2$:Eu.

The following lists some additional suitable phosphors used as conversion particles phosphor layer 66, although others can be used. Each exhibits excitation in the blue and/or UV emission spectrum, provides a desirable peak emission, has efficient light conversion, and has acceptable Stokes shift:

Yellow/Green $(Sr,Ca,Ba)(Al,Ga)_2S_4:Eu^{2+}$ $Ba_2(Mg,Zn)Si_2O_7:Eu^{2+}$ $Gd_{0.46}Sr_{0.31}Al_{1.23}O_xF_{1.38}:Eu^{2+}{}_{0.06}$ $(Ba_{1-x-y}Sr_xCa_y)SiO_4$:Eu $Ba_2SiO_4:Eu^{2+}$ Red $Lu_2O_3:Eu^{3+}$ $(Sr_{2-x}La_x)(Ce_{1-x}Eu_xO_4$ $Sr_2Ce_{1-x}Eu_xO_4$ $Sr_{2-x}Eu_xCeO_4$ $SrTiO_3:Pr^{3+},Ga^{3+}$ $CaAlSiN_3:Eu^{2+}$ $Sr_2Si_5N_8:Eu^{2+}$ Different sized phosphor particles can be used including but not limited to particles in the range of 10 nanometers (nm) to 30 micrometers (μm), or larger. Smaller particle sizes typically scatter and mix colors better than larger sized particles to provide a more uniform light. Larger particles are typically more efficient at converting light compared to smaller particles, but emit a less uniform light. In some embodiments, the phosphor can be provided in the phosphor layer 66 in a binder, and the phosphor can also have different concentrations or loading of phosphor materials in the binder. A typical concentration being in a range of 30-70% by weight. In one embodiment, the phosphor concentration is approximately 65% by weight, and is preferably uniformly dispersed throughout the remote phosphor. The phosphor layer 66 can also have different regions with different conversion materials and different concentrations of conversion material.

Different materials can be used for the binder, with materials preferably being robust after curing and substantially transparent in the visible wavelength spectrum. Suitable materials include silicones, epoxies, glass, inorganic glass, dielectrics, BCB, polymides, polymers and hybrids thereof, with the preferred material being silicone because of its high transparency and reliability in high power LEDs. Suitable phenyl- and methyl-based silicones are commercially available from Dow® Chemical. The binder can be cured using many different curing methods depending on different factors such as the type of binder used. Different curing methods include but are not limited to heat, ultraviolet (UV), infrared (IR) or air curing.

Phosphor layer 66 can be applied using different processes including but not limited to spin coating, sputtering, printing, powder coating, electrophoretic deposition (EPD), electrostatic deposition, among others. As mentioned above, the phosphor layer 66 can be applied along with a binder material, but it is understood that a binder is not required. In still other embodiments, the phosphor layer 66 can be separately fabricated and then mounted to the carrier layer 64.

In one embodiment, a phosphor-binder mixture can be sprayed or dispersed over the carrier layer 64 with the binder then being cured to form the phosphor layer 66. In some of these embodiments the phosphor-binder mixture can be sprayed, poured or dispersed onto or over the a heated carrier layer 64 so that when the phosphor binder mixture contacts the carrier layer 64, heat from the carrier layer spreads into and cures the binder. These processes can also include a solvent in the phosphor-binder mixture that can liquefy and lower the viscosity of the mixture making it more compatible with spraying. Many different solvents can be used including but not limited to toluene, benzene, zylene, or OS-20 commercially available from Dow Corning®, and different concentration of the solvent can be used. When the solvent-phosphor-binder mixture is sprayed or dispersed on the heated carrier layer 64 the heat from the carrier layer 64 evaporates the solvent, with the temperature of the carrier layer impacting how quickly the solvent is evaporated. The heat from the carrier layer 64 can also cure the binder in the mixture leaving a fixed phosphor layer on the carrier layer. The carrier layer 64 can be heated to many different temperatures depending on the materials being used and the desired solvent evaporation and binder curing speed. A suitable range of temperature is 90 to 150° C., but it is understood that other temperatures can also be used. Various deposition methods and systems are described in U.S. Patent Application Publication No. 2010/0155763, to Donofrio et al., titled "Systems and Methods for Application of Optical Materials to Optical Elements," and also assigned to Cree, Inc. and incorporated herein in its entirety.

The phosphor layer 66 can have many different thicknesses depending at least partially on the concentration of phosphor material and the desired amount of light to be converted by the phosphor layer 66. Phosphor layers according to the present invention can be applied with concentration levels (phosphor loading) above 30%. Other embodiments can have concentration levels above 50%, while in still others the concentration level can be above 60%. In some embodiments the phosphor layer can have thicknesses in the range of 10-100 microns, while in other embodiments it can have thicknesses in the range of 40-50 microns.

The methods described above can be used to apply multiple layers of the same of different phosphor materials and different phosphor materials can be applied in different areas of the carrier layer using known masking processes. The methods described above provide some thickness control for the phosphor layer 66, but for even greater thickness control the phosphor layer can be ground using known methods to reduce the thickness of the phosphor layer 66 or to even out the thickness over the entire layer. This grinding feature provides the added advantage of being able to produce lamps emitting within a single bin on the CIE chromaticity graph. Binning is generally known in the art and is intended to ensure that the LEDs or lamps provided to the end customer emit light within an acceptable color range. The LEDs or lamps can be tested and sorted by color or brightness into different bins, generally referred to in the art as binning. Each bin typically contains LEDs or lamps from one color and brightness group and is typically identified by a bin code. White emitting LEDs or lamps can be sorted by chromaticity (color) and luminous flux (brightness). The thickness control of the phosphor layer provides greater control in producing lamps that emit light within a target bin by controlling the amount of light source light converted by the phosphor layer. Multiple phosphor carriers 62 with the same thickness of phosphor layer 66 can be provided. By using a light source 58 with substantially the same emission characteristics, lamps can be manufactured having nearly the same emission characteristics that in some instances can fall within a single bin. In some embodiments, the lamp emissions fall within a standard deviation from a point on a CIE diagram, and in some embodiments the standard deviation comprises less than a 10-step McAdams ellipse. In some embodiments the emission of the lamps falls within a 4-step McAdams ellipse centered at CIExy(0.313, 0.323).

The phosphor carrier 62 can be mounted and bonded over the opening in the cavity 54 using different known methods or materials such as thermally conductive bonding materials or a thermal grease. Conventional thermally conductive grease can contain ceramic materials such as beryllium oxide and aluminum nitride or metal particles such colloidal silver. In other embodiments the phosphor carrier can be mounted over the opening using thermal conductive devices such as clamping mechanisms, screws, or thermal adhesive hold phosphor carrier 62 tightly to the heat sink structure to maximize thermal conductivity. In one embodiment a thermal grease layer is used having a thickness of approximately 100 μm and thermal conductivity of k=0.2 W/m-k. This arrangement provides an efficient thermally conductive path for dissipating heat from the phosphor layer 66. As mentioned above, different lamp embodiments can be provided without cavity and the phosphor carrier can be mounted in many different ways beyond over an opening to the cavity.

During operation of the lamp 50 phosphor conversion heating is concentrated in the phosphor layer 66, such as in the center of the phosphor layer 66 where the majority of LED light strikes and passes through the phosphor carrier 62. The thermally conductive properties of the carrier layer 64 spreads this heat laterally toward the edges of the phosphor carrier 62 as shown by first heat flow 70. There the heat passes through the thermal grease layer and into the heat sink structure 52 as shown by second heat flow 72 where it can efficiently dissipate into the ambient.

As discussed above, in the lamp 50 the platform 56 and the heat sink structure 52 can be thermally connected or coupled. This coupled arrangement results in the phosphor carrier 62 and that light source 58 at least partially sharing a thermally conductive path for dissipating heat. Heat passing through the platform 56 from the light source 58 as shown by third heat flow 74 can also spread to the heat sink structure 52. Heat from the phosphor carrier 62 flowing into the heat sink structure 52 can also flow into the platform 56. As further described below, in other embodiments, the phosphor carrier 62 and the light source 54 can have separate thermally conductive paths for dissipating heat, with these separate paths being referred to as "decoupled".

It is understood that the phosphor carriers can be arranged in many different ways beyond the embodiment shown in FIG. 4. The phosphor layer can be on any surface of the carrier layer or can be mixed in with the carrier layer. The phosphor carriers can also comprise scattering layers that can be included on or mixed in with the phosphor layer or carrier layer. It is also understood that the phosphor and scattering layers can cover less than a surface of the carrier layer and in some embodiments the conversion layer and scattering layer can have different concentrations in different areas. It is also understood that the phosphor carrier can have different roughened or shaped surfaces to enhance emission through the phosphor carrier.

As mentioned above, the diffuser is arranged to disperse light from the phosphor carrier and LED into the desired lamp emission pattern, and can have many different shapes and sizes. In some embodiments, the diffuser also can be arranged over the phosphor carrier to mask the phosphor carrier when the lamp is not emitting. The diffuser can have materials to give a substantially white appearance to give the bulb a white appearance when the lamp is not emitting.

There are at least four attributes or characteristics of the diffuser that can be used to control the output beam characteristics for the lamp 50. The first is diffuser geometry independent of the phosphor layer geometry. The second is the diffuser geometry relative to the phosphor layer geometry. The third is diffuser scattering properties including the nature of the scattering layer and smoothness/roughness of the diffuser surfaces. The fourth is the diffuser distribution across the surface such as intentional non-uniformity of the scattering. These attributes allow for control of, for example, the ratio of axially emitted light relative to "sideways" emitted light (~90°), and also relative to "high angle" (>~130°). These attributes can also apply differently depending on the geometry of and pattern of light emitted by the phosphor carrier and the light source.

For two-dimensional phosphor carriers and/or light sources such as those shown in FIG. 4, the light emitted is generally forward directed (e.g. Lambertian). For these embodiments, the attributes listed above can provide for the dispersion of the forward directed emission pattern into broad beam intensity profiles. Variations in the second and fourth attributes that can be particularly applicable to achieving broad beam omnidirectional emission from forward directed emission profile.

For three-dimensional phosphor carriers (described in more detail below) and three dimensional light sources, the light emitted can already have significant emission intensity at greater than 90° provided that the emission is not blocked by other lamp surfaces, such as the heat sink. As a result, the diffuser attributes listed above can be utilized to provide further adjustment or fine-tuning to the beam profile from the phosphor carrier and light source so that it more closely matches the desired output beam intensity, color uniformity, color point, etc. In some embodiments, the beam profile can be adjusted to substantially match the output from conventional incandescent bulbs.

As for the first attribute above regarding diffuser geometry independent of phosphor geometry, in those embodiments where light is emitted uniformly from the diffuser surface, the amount of light directed "forward" (axially or ~0°) relative to sideways (~90°), and relative to "high angle" (>~130°), can depend greatly on the cross sectional area of the diffuser when viewed from that angle. Many different diffusers having different shapes and attributes can be used in different embodiments herein, including but not limited to these shown and described in U.S. Provisional Patent Application No. 61/339,515, to Tong et al., titled "LED Lamp With Remote Phosphor and Diffuser Configuration" and U.S. patent application Ser. No. 12/901,405, to Tong et al., titled "Non-uniform Diffuser to Scatter Light into Uniform Emission Pattern," both of which also assigned to Cree, Inc. and incorporated herein in their entirety.

The lamps according to the present invention can comprise many different features beyond those described above. Referring again to FIG. 4, in those lamp embodiments having a cavity 54 can be filled with a transparent heat conductive material to further enhance heat dissipation for the lamp. The cavity conductive material could provide a secondary path for dissipating heat from the light source 58. Heat from the light source would still conduct through the platform 56, but could also pass through the cavity material to the heat sink structure 52. This would allow for lower operating temperature for the light source 58, but presents the danger of elevated operating temperature for the phosphor carrier 62. This arrangement can be used in many different embodiments, but is particularly applicable to lamps having higher light source operating temperatures compared to that of the phosphor carrier. This arrangement allows for the heat to be more efficiently spread from the light source in applications where additional heating of the phosphor carrier layer can be tolerated.

Figure 5:
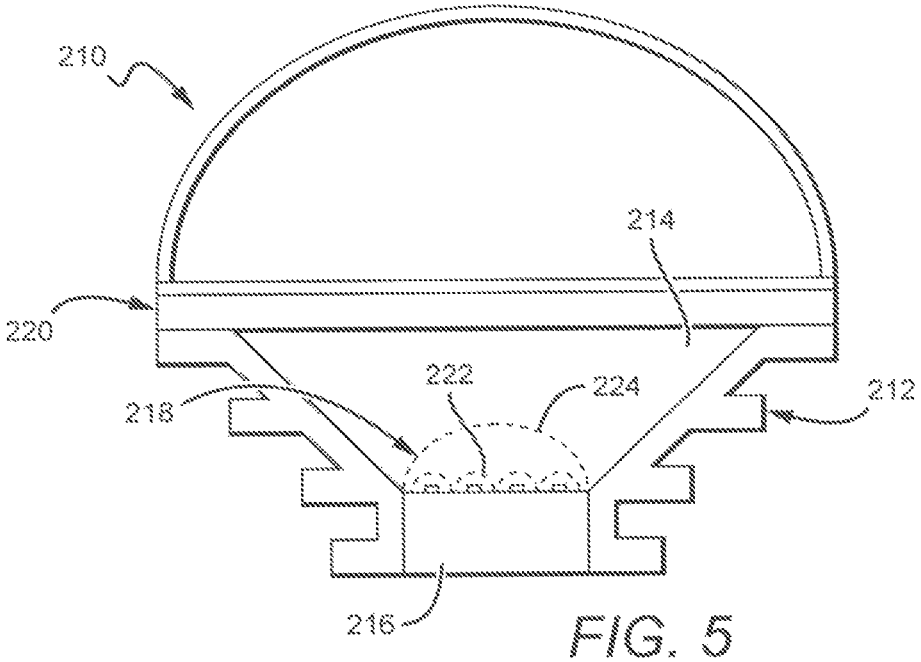
FIG. 5 is a sectional view of another embodiment of a lamp according to the present invention having a diffuser dome.

As discussed above, different lamp embodiments according to the present invention can be arranged with many different types of light sources. FIG. 5 shows another embodiment of a lamp 210 similar to the lamp 50 described above and shown in FIG. 4. The lamp 210 comprises a heat sink structure 212 having a cavity 214 with a platform 216 arranged to hold a light source 218. A phosphor carrier 220 can be included over and at least partially covering the opening to the cavity 214. In this embodiment, the light source 218 can comprise a plurality of LEDs arranged in separate LED packages or arranged in an array in single multiple LED packages. For the embodiments comprising separate LED packages, each of the LEDs can comprise its own primary optics or lens 222. In embodiments having a single multiple LED package, a single primary optic or lens 224 can cover all the LEDs. It is also understood that the LED and LED arrays can have secondary optics or can be provided with a combination of primary and secondary optics. It is understood that the LEDs can be provided without lenses and that in the array embodiments each of the LEDs can have its own lens. Like the lamp 50, the heat sink structure and platform can be arranged with the necessary electrical traces or wires to provide an electrical signal to the light source 218. In each embodiment, the emitters can be coupled on different series and parallel arrangement. In one embodiment eight LEDs can be used that are connected in series with two wires to a circuit board. The wires can then be connected to the power supply unit described above. In other embodiments, more or less than eight LEDs can be used and as mentioned above, commercially available LEDs from Cree, Inc. can used including eight XLamp® XP-E LEDs or four XLamp® XP-G LEDs. Different single string LED circuits are described in U.S. patent application Ser. No. 12/566,195, to van de Ven et al., entitled "Color Control of Single String Light Emitting Devices Having Single String Color Control, and U.S. patent application Ser. No. 12/704,730 to van de Ven et al., entitled "Solid State Lighting Apparatus with Compensation Bypass Circuits and Methods of Operation Thereof", both of with are incorporated herein by reference.

In the lamps 50 and 210 described above, the light source and the phosphor carrier share a thermal path for dissipating heat, referred to as being thermally coupled. In some embodiments the heat dissipation of the phosphor carrier may be enhanced if the thermal paths for the phosphor carrier and the light source are not thermally connected, referred to as thermally decoupled.

Figure 6:
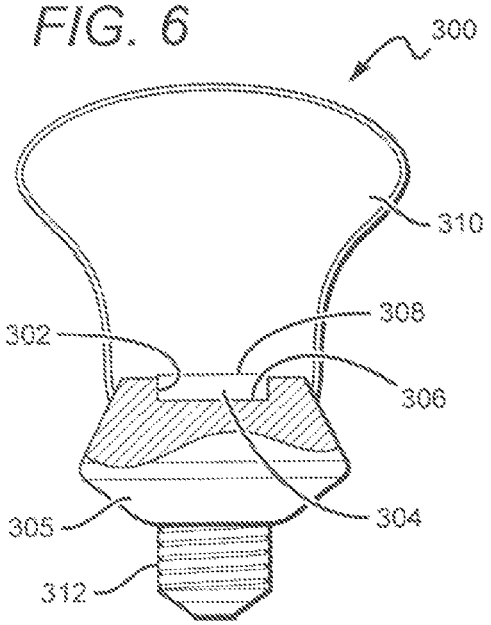
FIG. 6 is a sectional view of another embodiment of a lamp according to the present invention.

FIG. 6 shows still another embodiment of lamp 300 according to the present invention that comprises an optical cavity 302 within a heat sink structure 305. Like the embodiments above, the lamp 300 can also be provided without a lamp cavity, with the LEDs mounted on a surface of the heat sink or on a three dimensional or pedestal structures having different shapes. A planar LED based light source 304 is mounted to the platform 306, and a phosphor carrier 308 is mounted to the top opening of the cavity 302, with the phosphor carrier 308 having any of the features of those described above. In the embodiment shown, the phosphor carrier 308 can be in a flat disk shape and comprises a thermally conductive transparent material and a phosphor layer. It can be mounted to the cavity with a thermally conductive material or device as described above. The cavity 302 can have reflective surfaces to enhance the emission efficiency as described above.

Light from the light source 304 passes through the phosphor carrier 308 where a portion of it is converted to a different wavelength of light by the phosphor in the phosphor carrier 308. In one embodiment the light source 304 can comprise blue emitting LEDs and the phosphor carrier 308 can comprise a yellow phosphor as described above that absorbs a portion of the blue light and re-emits yellow light. The lamp 300 emits a white light combination of LED light and yellow phosphor light. Like above, the light source 304 can also comprise many different LEDs emitting different colors of light and the phosphor carrier can comprise other phosphors to generate light with the desired color temperature and rendering.

The lamp 300 also comprises a shaped diffuser dome 310 mounted over the cavity 302 that includes diffusing or scattering particles such as those listed above. The scattering particles can be provided in a curable binder that is formed in the general shape of dome. In the embodiment shown, the dome 310 is mounted to the heat sink structure 305 and has an enlarged portion at the end opposite the heat sink structure 305. Different binder materials can be used as discussed above such as silicones, epoxies, glass, inorganic glass, dielectrics, BCB, polymides, polymers and hybrids thereof. In some embodiments white scattering particles can be used with the dome having a white color that hides the color of the phosphor in the phosphor carrier 308 in the optical cavity. This gives the overall lamp 300 a white appearance that is generally more visually acceptable or appealing to consumers than the color of the phosphor. In one embodiment the diffuser can include white titanium dioxide particles that can give the diffuser dome 310 its overall white appearance.

The diffuser dome 310 can provide the added advantage of distributing the light emitting from the optical cavity in a more uniform pattern. As discussed above, light from the light source in the optical cavity can be emitted in a generally Lambertian pattern and the shape of the dome 310 along with the scattering properties of the scattering particles causes light to emit from the dome in a more omnidirectional emission pattern. An engineered dome can have scattering particles in different concentrations in different regions or can be shaped to a specific emission pattern. In some embodiments the dome can be engineered so that the emission pattern from the lamp complies with the Department of Energy (DOE) Energy Star defined omnidirectional distribution criteria. One requirement of this standard met by the lamp 300 is that the emission uniformity must be within 20% of mean value from 0 to 135° viewing and; >5% of total flux from the lamp must be emitted in the 135-180° emission zone, with the measurements taken at 0, 45, 90° azimuthal angles. As mentioned above, the different lamp embodiments described herein can also comprise A-type retrofit LED bulbs that meet the DOE Energy Star standards. The present invention provides lamps that are efficient, reliable and cost effective. In some embodiments, the entire lamp can comprise five components that can be quickly and easily assembled.

Like the embodiments above, the lamp 300 can comprise a mounting mechanism of the type to fit in conventional electrical receptacles. In the embodiment shown, the lamp 300 includes a screw-threaded portion 312 for mounting to a standard Edison socket. Like the embodiments above, the lamp 300 can include standard plug and the electrical receptacle can be a standard outlet, or can comprise a GU24 base unit, or it can be a clip and the electrical receptacle can be a receptacle which receives and retains the clip (e.g., as used in many fluorescent lights).

As mentioned above, the space between some of the features of the lamp 300 can be considered mixing chambers, with the space between the light source 306 and the phosphor carrier 308 comprising a first light mixing chamber. The space between the phosphor carrier 308 and the diffuser 310 can comprise a second light mixing chamber, with the mixing chamber promoting uniform color and intensity emission for said lamp. The same can apply to the embodiments below having different shaped phosphor carriers and diffusers. In other embodiments, additional diffusers and/or phosphor carriers can be included forming additional mixing chambers, and the diffusers and/or phosphor carriers can be arranged in different orders.

Figure 7:
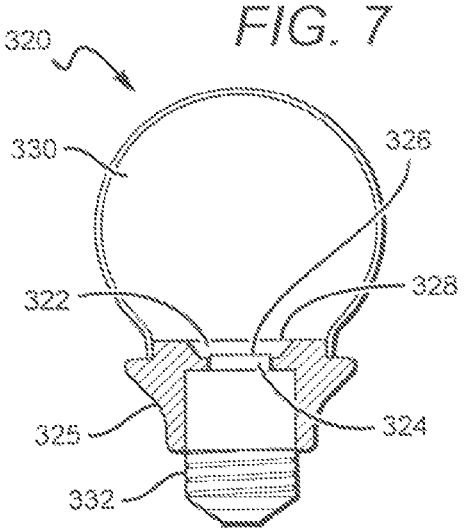
FIG. 7 is a sectional view of another embodiment of a lamp according to the present invention having a diffuser dome.

Different lamp embodiments according to the present invention can have many different shapes and sizes. FIG. 7 shows another embodiment of a lamp 320 according to the present invention that is similar to the lamp 300 and similarly comprises an optical cavity 322 in a heat sink structure 325 with a light source 324 mounted to the platform 326 in the optical cavity 322. Like above, the heat sink structure need not have an optical cavity, and the light sources can be provided on other structures beyond a heat sink structure. These can include planar surfaces or pedestals having the light source. A phosphor carrier 328 is mounted over the cavity opening with a thermal connection. The lamp 320 also comprises a diffuser dome 330 mounted to the heat sink structure 325, over the optical cavity. The diffuser dome can be made of the same materials as diffuser dome 310 described above and shown in FIG. 15, but in this embodiment the dome 300 is oval or egg shaped to provide a different lamp emission pattern while still masking the color from the phosphor in the phosphor carrier 328. It is also noted that the heat sink structure 325 and the platform 326 are thermally de-coupled. That is, there is a space between the platform 326 and the heat sink structure such that they do not share a thermal path for dissipating heat. As mentioned above, this can provide improved heat dissipation from the phosphor carrier compared to lamps not having de-coupled heat paths. The lamp 300 also comprises a screw-threaded portion 332 for mounting to an Edison socket.

Figure 8:
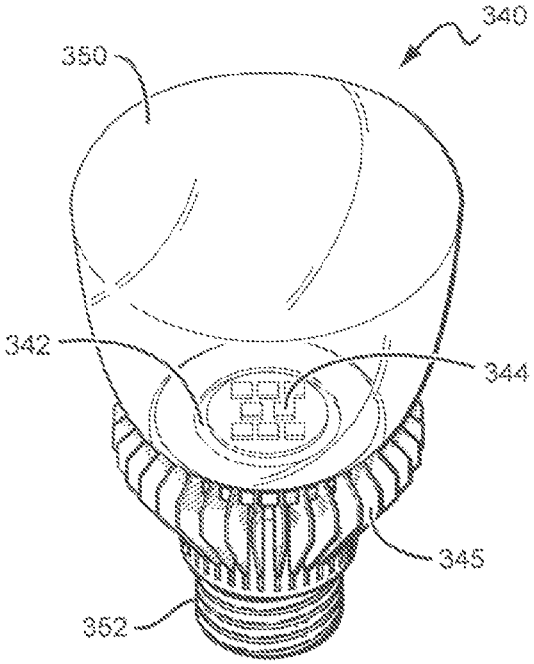
FIG. 8 is a perspective view of another embodiment of a lamp according to the present invention with a diffuser dome having a different shape.
Figure 9:
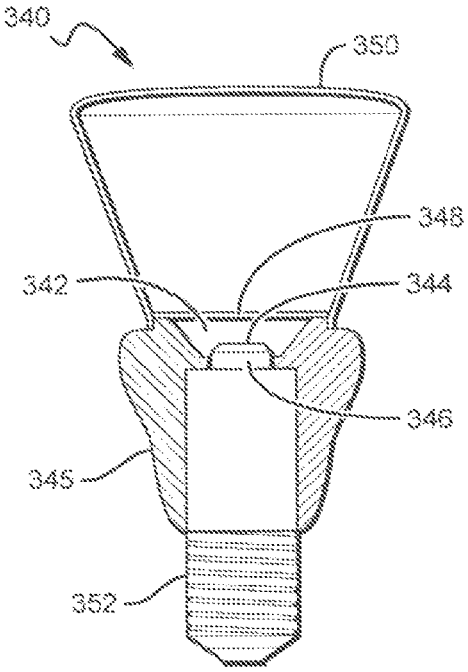
FIG. 9 is a sectional view of the lamp shown in FIG. 8.

FIGS. 8 through 10 show another embodiment of a lamp 340 according to the present invention that is similar to the lamp 320 shown in FIG. 31. It comprises a heat sink structure 345 having an optical cavity 342 with a light source 344 on the platform 346, and a phosphor carrier 348 over the optical cavity. It further comprises a screw-threaded portion 352. It also includes a diffuser dome 350, but in this embodiment the diffuser dome is flattened on top to provide the desired emission pattern while still masking the color of the phosphor.

The lamp 340 also comprises an interface layer 354 between the light source 344 and the heat sink structure 345 from the light source 344. In some embodiments the interface layer can comprise a thermally insulating material and the light source 344 can have features that promote dissipation of heat from the emitters to the edge of the light source's substrate. This can promote heat dissipation to the outer edges of the heat sink structure 345 where it can dissipate through the heat fins. In other embodiments the interface layer 354 can be electrically insulating to electrically isolate the heat sink structure 345 from the light source 344. Electrical connection can then be made to the top surface of the light source.

In the embodiments above, the phosphor carriers are two dimensional (or flat/planar) with the LEDs in the light source being co-planer. It is understood, however, that in other lamp embodiments the phosphor carriers can take many different shapes including different three-dimensional shapes. The term three-dimensional is meant to mean any shape other than planar as shown in the above embodiments. FIGS. 35 through 38 show different embodiments of three-dimensional phosphor carriers according to the present invention, but it is understood that they can also take many other shapes. As discussed above, when the phosphor absorbs and re-emits light, it is re-emitted in an isotropic fashion, such that the 3-dimensional phosphor carrier serves to convert and also disperse light from the light source. Like the diffusers described above, the different shapes of the 3-dimensional carrier layers can emit light in emission patterns having different characteristics that depends partially on the emission pattern of the light source. The diffuser can then be matched with the emission of the phosphor carrier to provide the desired lamp emission pattern.

FIG. 11 shows a hemispheric shaped phosphor carrier 354 comprising a hemispheric carrier 355 and phosphor layer 356. The hemispheric carrier 355 can be made of the same materials as the carrier layers described above, and the phosphor layer can be made of the same materials as the phosphor layer described above, and scattering particles can be included in the carrier and phosphor layer as described above.

In this embodiment the phosphor layer 356 is shown on the outside surface of the carrier 355 although it is understood that the phosphor layer can be on the carrier's inside layer, mixed in with the carrier, or any combination of the three. In some embodiments, having the phosphor layer on the outside surface may minimize emission losses. When emitter light is absorbed by the phosphor layer 356 it is emitted omnidirectionally and some of the light can emit backwards and be absorbed by the lamp elements such as the LEDs. The phosphor layer 356 can also have an index of refraction that is different from the hemispheric carrier 355 such that light emitting forward from the phosphor layer can be reflected back from the inside surface of the carrier 355. This light can also be lost due to absorption by the lamp elements. With the phosphor layer 356 on the outside surface of the carrier 355, light emitted forward does not need to pass through the carrier 355 and will not be lost to reflection. Light that is emitted back will encounter the top of the carrier where at least some of it will reflect back. This arrangement results in a reduction of light from the phosphor layer 356 that emits back into the carrier where it can be absorbed.

The phosphor layer 356 can be deposited using many of the same methods described above. In some instances the three-dimensional shape of the carrier 355 may require additional steps or other processes to provide the necessary coverage. In the embodiments where a solvent-phosphor-binder mixture is sprayed and the carrier can be heated as described above and multiple spray nozzles may be needed to provide the desired coverage over the carrier, such as approximate uniform coverage. In other embodiments, fewer spray nozzles can be used while spinning the carrier to provide the desired coverage. Like above, the heat from the carrier 355 can evaporate the solvent and helps cure the binder.

In still other embodiments, the phosphor layer can be formed through an emersion process whereby the phosphor layer can be formed on the inside or outside surface of the carrier 355, but is particularly applicable to forming on the inside surface. The carrier 355 can be at least partially filled with, or otherwise brought into contact with, a phosphor mixture that adheres to the surface of the carrier. The mixture can then be drained from the carrier leaving behind a layer of the phosphor mixture on the surface, which can then be cured. In one embodiment, the mixture can comprise polyethylen oxide (PEO) and a phosphor. The carrier can be filled and then drained, leaving behind a layer of the PEO-phosphor mixture, which can then be heat cured. The PEO evaporates or is driven off by the heat leaving behind a phosphor layer. In some embodiments, a binder can be applied to further fix the phosphor layer, while in other embodiments the phosphor can remain without a binder.

Like the processes used to coat the planar carrier layer, these processes can be utilized in three-dimensional carriers to apply multiple phosphor layers that can have the same or different phosphor materials. The phosphor layers can also be applied both on the inside and outside of the carrier, and can have different types having different thickness in different regions of the carrier. In still other embodiments different processes can be used such as coating the carrier with a sheet of phosphor material that can be thermally formed to the carrier.

In lamps utilizing the carrier 355, an emitter can be arranged at the base of the carrier so that light from the emitters emits up and passes through the carrier 355. In some embodiments the emitters can emit light in a generally Lambertian pattern, and the carrier can help disperse the light in a more uniform pattern.

FIG. 12 shows another embodiment of a three dimensional phosphor carrier 357 according to the present invention comprising a bullet-shaped carrier 358 and a phosphor layer 359 on the outside surface of the carrier. The carrier 358 and phosphor layer 359 can be formed of the same materials using the same methods as described above. The different shaped phosphor carrier can be used with a different emitter to provide the overall desired lamp emission pattern. FIG. 13 shows still another embodiment of a three dimensional phosphor carrier 360 according to the present invention comprising a globe-shaped carrier 361 and a phosphor layer 362 on the outside surface of the carrier. The carrier 361 and phosphor layer 362 can be formed of the same materials using the same methods as described above.

FIG. 14 shows still another embodiment phosphor carrier 363 according to the present invention having a generally globe shaped carrier 364 with a narrow neck portion 365. Like the embodiments above, the phosphor carrier 363 includes a phosphor layer 366 on the outside surface of the carrier 364 made of the same materials and formed using the same methods as those described above. In some embodiments, phosphor carriers having a shape similar to the carrier 364 can be more efficient in converting emitter light and re-emitting light from a Lambertian pattern from the light source, to a more uniform emission pattern.

Embodiments having a three-dimensional structure holding the LED, such as a pedestal, can provide an even more dispersed light pattern from the three-dimensional phosphor carrier. In these embodiments, the LEDs can be within the phosphor carrier at different angles so that they provide a light emitting pattern that is less Lambertian than a planar LED light source. This can then be further dispersed by the three-dimensional phosphor carrier, with the disperser fine-tuning the lamp's emission pattern.

Figure 15:
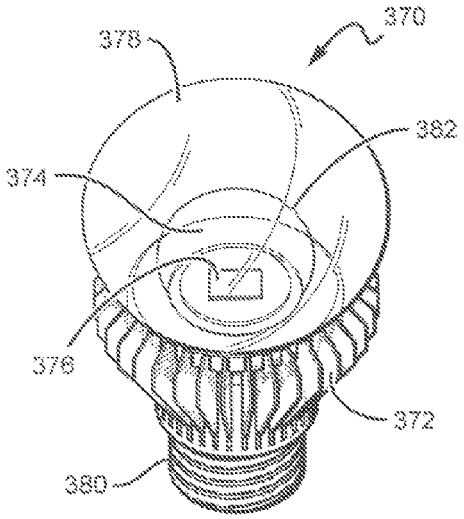
FIG. 15 is a perspective view of another embodiment of a lamp according to the present invention with a three-dimensional phosphor carrier.
Figure 17:
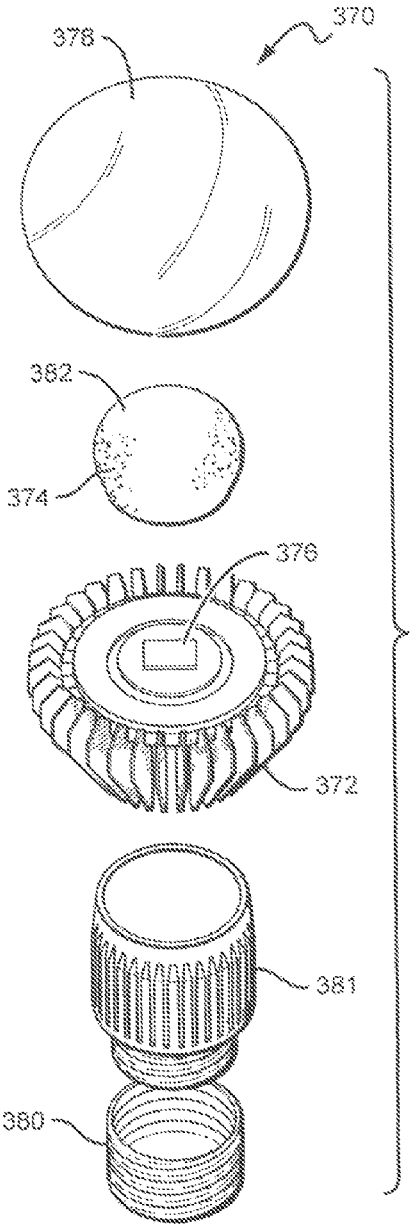
FIG. 17 is an exploded view of the lamp shown in FIG. 15.
Figure 16:
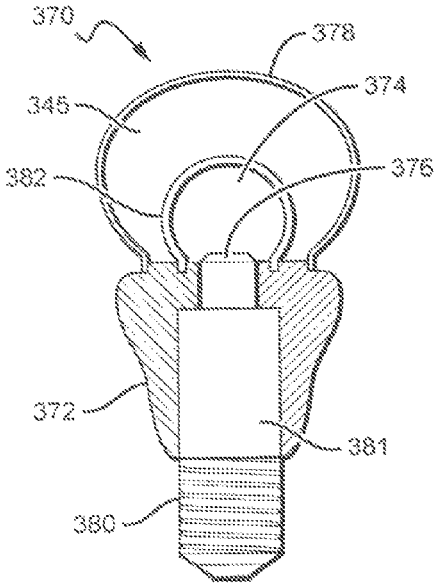
FIG. 16 is a sectional view of the lamp shown in FIG. 15.

FIGS. 15 through 17 show another embodiment of a lamp 370 according to the present invention having a heat sink structure 372, optical cavity 374, light source 376, diffuser dome 378, a screw-threaded portion 380, and a housing 381. This embodiment also comprises a three-dimensional phosphor carrier 382 that includes a thermally conductive transparent material and one phosphor layer. It is also mounted to the heat sink structure 372 with a thermal connection. In this embodiment, however, the phosphor carrier 382 is hemispheric shaped and the emitters are arranged so that light from the light source passes through the phosphor carrier 382 where at least some of it is converted.

The shape of the three dimensional shape of the phosphor carrier 382 provides natural separation between it and the light source 376. Accordingly, the light source 376 is not mounted in a recess in the heat sink that forms the optical cavity. Instead, the light source 376 is mounted on the top surface of the heat sink structure 372, with the optical cavity 374 formed by the space between the phosphor carrier 382 and the top of the heat sink structure 372. This arrangement can allow for a less Lambertian emission from the optical cavity 374 because there are no optical cavity side surfaces to block and redirect sideways emission.

In embodiments of the lamp 370 utilizing blue emitting LEDs for the light source 376 and yellow phosphor, the phosphor carrier 382 can appear yellow, and the diffuser dome 378 masks this color while dispersing the lamp light into the desired emission pattern. In lamp 370, the conductive paths for the platform and heat sink structure are coupled, but it is understood that in other embodiments they can be de-coupled.

FIG. 18 shows one embodiment of a lamp 390 according to the present invention comprising an eight LED light source 392 mounted on a heat sink 394 as described above. The emitters can be coupled together in many different ways and in the embodiment shown are serially connected. It is noted that in this embodiment the emitters are not mounted in an optical cavity, but are instead mounted on top planar surface of the heat sink 394. FIG. 19 shows the lamp 390 shown in FIG. 18 with a dome-shaped phosphor carrier 396 mounted over the light source 392. The lamp 390 shown in FIG. 19 can be combined with the diffuser 398 as shown in FIGS. 20 and 21 to form a lamp dispersed light emission.

Figure 22:
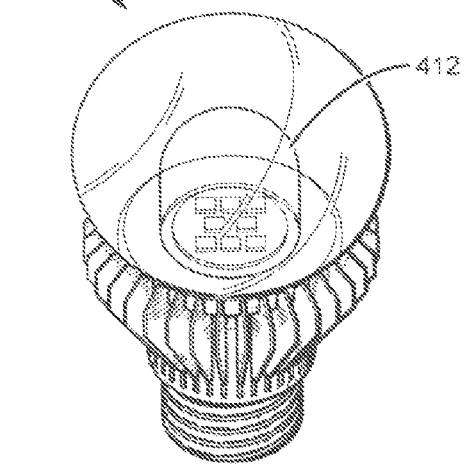
FIG. 22 is a perspective view of another embodiment of a lamp according to the present invention with a three-dimensional phosphor carrier.
Figure 23:
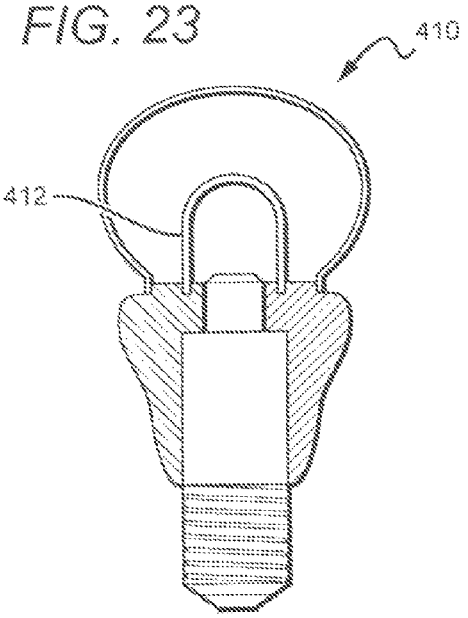
FIG. 23 is a sectional view of the lamp shown in FIG. 22.
Figure 24:
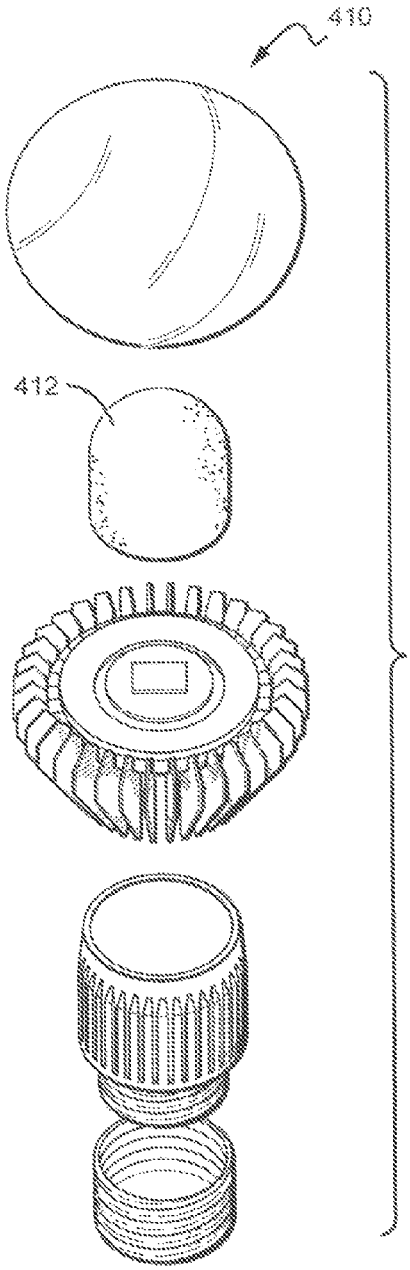
FIG. 24 is an exploded view of the lamp shown in FIG. 22.

FIGS. 22 through 24 show still another embodiment of a lamp 410 according to the present invention. It comprises many of the same features as the lamp 370 shown in FIGS. 15 through 17 above. In this embodiment, however, the phosphor carrier 412 is bullet shaped and functions in much the same way as the other embodiments of phosphor carriers described above. It is understood that these are only a couple of the different shapes that the phosphor carrier can take in different embodiments of the invention.

FIG. 25 shows another embodiment of a lamp 420 according to the present invention that also comprises a heat sink 422 with an optical cavity 424 having a lights source 426 and phosphor carrier 428. The lamp 420 also comprises a diffuser dome 430 and screw threaded portion 432. In this embodiment, however, the optical cavity 424 can comprise a separate collar structure 434, as shown in FIG. 26 that is removable from the heat sink 422. This provides a separate piece that can more easily be coated by a reflective material than the entire heat sink. The collar structure 434 can be threaded to mate with threads in the heat sink structure 422. The collar structure 434 can provide the added advantage of mechanically clamping down the PCB to the heat sink. In other embodiments the collar structure 434 can comprise a mechanical snap-on device instead of threads for easier manufacture.

As mentioned above, the shape and geometry of the three dimensional phosphor carriers can assist in transforming the emission pattern of the emitters to another more desirable emission pattern. In one embodiment, it can assist in changing a Lambertian emission pattern into a more uniform emission pattern at different angles. The disperser can then further transform the light from the phosphor carrier to the final desired emission pattern, while at the same time masking the yellow appearance of the phosphor when the light is off. Other factors can also contribute to the ability of the emitter, phosphor carrier and disperser combination to produce the desired emission pattern. FIG. 27 shows one embodiment of the emitter footprint 440, phosphor carrier footprint 442 and disperser footprint 444 for one lamp embodiment according to the present invention. The phosphor carrier footprint 442 and disperser footprint 444 show the lower edge of both these features around the emitter 440. Beyond the actual shape of these features, the distance D1 and D2 between the edges of these features can also impact the ability of the phosphor carrier and disperser to provide the desired emission pattern. The shape of these features along with the distances between the edges can be optimized based on the emission pattern of the emitters, to obtain the desired lamp emission pattern It is understood that in other embodiments different portions of the lamp can be removed such as the entire optical cavity. These features making the collar structure 414 removable could allow for easier coating optical cavity with a reflective layer and could also allow for removal and replacement of the optical cavity in case of failure.

The lamps according to the present invention can have a light source comprising many different numbers of LEDs with some embodiments having less than 30 and in other embodiments having less than 20. Still other embodiments can have less than 10 LEDs, with the cost and complexity of the lamp light source generally being lower with fewer LED chips. The area covered by the multiple chips light source in some embodiments can be less that 30 $mm^2$ and in other embodiments less than 20 $mm^2$. In still other embodiments it can be less that 10 $mm^2$. Some embodiments of lamps according to the present invention also provide a steady state lumen output of greater than 400 lumens and in other embodiments greater than 600 lumens. In still other embodiments the lamps can provide steady state lumen output of greater than 800 lumens. Some lamp embodiments can provide this lumen output with the lamp's heat management features allowing the lamp to remain relatively cool to the touch. In one embodiment that lamp remains less that 60° C. to the touch, and in other embodiments it remains less that 50° C. to the touch. In still other embodiments the lamp remains less than 40° C. to the touch.

Some embodiments of lamps according to the present invention can also operate at an efficiency of greater than lumens per watt, and in other embodiments at an efficiency of greater than 50 lumens per watt. In still other embodiments that lamps can operate at greater than 55 lumens per watt. Some embodiments of lamps according to the present invention can produce light with a color rendering index (CRI) greater than 70, and in other embodiments with a CRI greater than 80. In still other embodiments the lamps can operate at a CRI greater than 90. One embodiment of a lamp according to the present invention can have phosphors that provide lamp emission with a CRI greater than 80 and a lumen equivalent of radiation (LER) greater than 320 lumens/optical Watt @ 3000 K correlated color temperature (CCT).

Lamps according to the present invention can also emit light in a distribution that is within 40% of a mean value in the 0 to 135° viewing angles, and in other embodiment the distribution can be within 30% of a mean value at the same viewing angles. Still other embodiments can have a distribution of 20% of a mean value at the same viewing angles in compliance with Energy Star specifications. The embodiments can also emit light that is greater than 5% of total flux in the 135 to 180° viewing angles.

It is understood that lamps or bulbs according to the present invention can be arranged in many different ways beyond the embodiments described above. The embodiments above are discussed with reference to a remote phosphor but it is understood that alternative embodiments can comprise at least some LEDs with conformal phosphor layer. This can be particularly applicable to lamps having light sources emitting different colors of light from different types of emitters. These embodiments can otherwise have some or all of the features described above. These different arrangement can include those shown and described in U.S. Provisional Patent Application No. 61/339,515, to Tong et al., titled "LED Lamp With Remote Phosphor and Diffuser Configuration" and U.S. patent application Ser. No. 12/901,405, to Tong et al., titled "Non-uniform Diffuser to Scatter Light into Uniform Emission Pattern," incorporated above.

As discussed above, the lamps according to the present invention can comprise active elements to help reduce convective thermal resistance. Many different active elements can be used, and some embodiments can comprise one or more fans that can be provided in many different locations in different embodiments according to the present invention. The fans can be arranged to agitate the air around certain elements of the lamps to decrease convective thermal resistance. They can be used in lamps having heat sinks arranged in different ways or those without heat sinks.

FIGS. 28 and 29 show one embodiment of a lamp 700 according to the present invention that can take many different shapes and sizes, but in the embodiment shown has dimensions to fit an A-lamp size envelope as shown in FIG.

3. The lamp 700 comprises a heat sink 702, with LEDs 704 mounted to a pedestal 706, which is in turn mounted to the heat sink 702. LEDs can be mounted to many different pedestal shapes such as those disclosed in U.S. patent application Ser. No. 12/848,825, to Tong et al., filed on Aug. 2, 2010, and entitled "LED-Based Pedestal-Type Lighting Structure." This application is incorporated herein by reference. The LEDs can also be provided in a planar arrangement as described and shown in the embodiments above.

The heat sink 702 is similar to the heat sinks described in the embodiments above and can be in thermal contact with all or some of the lamps heat generating elements to dissipate heat generated during operation. Similar to the heat sinks above the heat sink 702 can at least partially comprise a thermally conductive material, and many different thermally conductive materials can be used including different metals such as copper or aluminum, or metal alloys. The heat sink 702 can also comprise heat fins 708 that increase the surface area of the heat sink 702 to facilitate more efficient dissipation into the ambient. In the embodiment shown the fins 708 are shown in a generally horizontal/longitudinal orientation, but it is understood that in other embodiments the fins can have a vertical/orthogonal or angled orientation.

The lamp 700 further comprises a base/socket 710 that comprises a feature that allows the lamp to be screwed into or connected to a power source, such as an Edison socket. As above, other embodiments can include a standard plug and the electrical receptacle can be a standard outlet, can comprise a GU24 base unit, or it can be a clip and the electrical receptacle can be a receptacle which receives and retains the clip (e.g., as used in many fluorescent lights). Similar to the embodiments above, the base/socket can also comprise a power supply or power conversion unit that can include a driver to allow the bulb to run from an AC line voltage/current, and in some embodiments to provide light source dimming capabilities.

The lamp 700 also comprises a bulb or diffuser dome 712 that can have the characteristics of the diffuser domes described above. It should include diffuser scattering properties, and different embodiments of the diffuser dome 712 can comprise a carrier made of different materials such as glass or plastics, and one or more scattering films, layers or regions. As discussed above, the scattering properties of the diffuser dome can be provided as one or more of the scattering particles listed above. In some embodiments, the diffuser dome 712 can be arranged to scatter the light emitted from the LEDs 704 on the pedestal 706 into a more uniform emission pattern. That is, the scattering properties of the diffuser dome 712 can change the light pattern from the LEDs 704 to a more uniform emission patter. It is understood that the lamp can also comprise a phosphor carrier arranged in a planar or three-dimensional manner as described above.

A fan 714 is included in the lamp 700, and in the embodiment shown the fan 714 is located at the base of the heat sink 702, between the base 710 and the heat sink 702. The fan 714 is arranged to draw in ambient air and to flow air over the surface of the heat sink 702. Power is supplied to the fan 714 (and the LEDs 704) from the drive circuitry in the base 710.

FIGS. 30 through 32 show one embodiment of a fan 714 according to the present invention. The fan 714 comprises a rotor 716 that rotates about a central mount 718 in response to an electrical signal. The central mount 718 can comprise bearing 720 to allow relatively free rotation of the rotor. Different types of bearings can be used, with the preferred bearings being ceramic which improves the lifespan of the fan. The center mount 718 also comprises electrical contacts 722, two of which are provided to apply an electrical signal to the fan 714. Others of the contacts 722 are arranged to pass through the central mount 718 so that that an electrical signal applied to the contacts passes through to be supplied to the LEDs 704.

The fan 714 can be many different shapes and sizes and in some embodiments can be less than 100 mm in diameter. In other embodiments it can be less that 75 mm in diameter, and in still other embodiments it can be less than 50 mm in diameter. In one embodiment, the fan 714 can be approximately 40 mm in diameter. The fan can also be arranged to move different rates of air, with some embodiments moving less than 3 cubic feat per minute (CFM) and others moving less than 2 CFM. In one embodiment the rate of air flow is approximately 1 CFM. The power consumed by the fan should be as low as possible, with the some embodiments consuming less that 0.5 W and others consuming less than 0.3 W. In still other embodiments the fan can consume less than 0.1 W. The noise produced by the fan should also be minimized with some embodiments producing less than 30 decibels (dB) of noise and others producing less than 20 dB. In still other embodiments, the fan can produce less than 15 dB. The reliability of the fan should be maximized, with some embodiments having a lifetime of greater than 50,000 hours and others having a lifetime of greater than 100,000 hours. The cost should also be minimized, with the some embodiments costing less than one dollar each.

In some embodiments rotation of the rotor 716 can have an approximate linear dependence on fan drive voltage. In one embodiment, a drive voltage of 3.5V produces rotor rotation of 820 rpm, with the power consumption of the fan estimated at approximately 0.1 W. At a drive voltage of 12V the rotor rotates at 3600 rpm, and produces noise in the range of 20 s dB. It is estimated that the noise produced at 3.5V operation is much lower and can be in 10 s dB range. Fans with ceramic ball bearings can increase operating lifetime to greater than 100 k hours under normal operating conditions. At reduced rotation speed (e.g. 3.5V) the lifetime of the fans can also be longer.

FIGS. 33 and 34 show the experimental effectiveness of the fan in reducing convective thermal resistance of a heat sink. The convective thermal resistance for commercial heat sinks T for an A-bulb replacement (FIG. 33), and heat sink S for MR16 lamps (FIG. 34) was measured using a conventional 40 mm fan. With the fans off (pure natural convection) the heat sinks T and S exhibited convective thermal resistance of 8 and 13° C./W, respectively. With the fan operating at the nominal 12V condition, the convective thermal resistance was approximately 2.5 and 2.7° C./W respectively (or 69% and 79% lower that pure natural convection values, respectively). At reduced operating condition of 3.5V for the fan, the convective thermal resistances were 5.9° C./W and 6.1° C./w, respectively (or 26% and 53% lower than pure natural convection).

Figure 35:
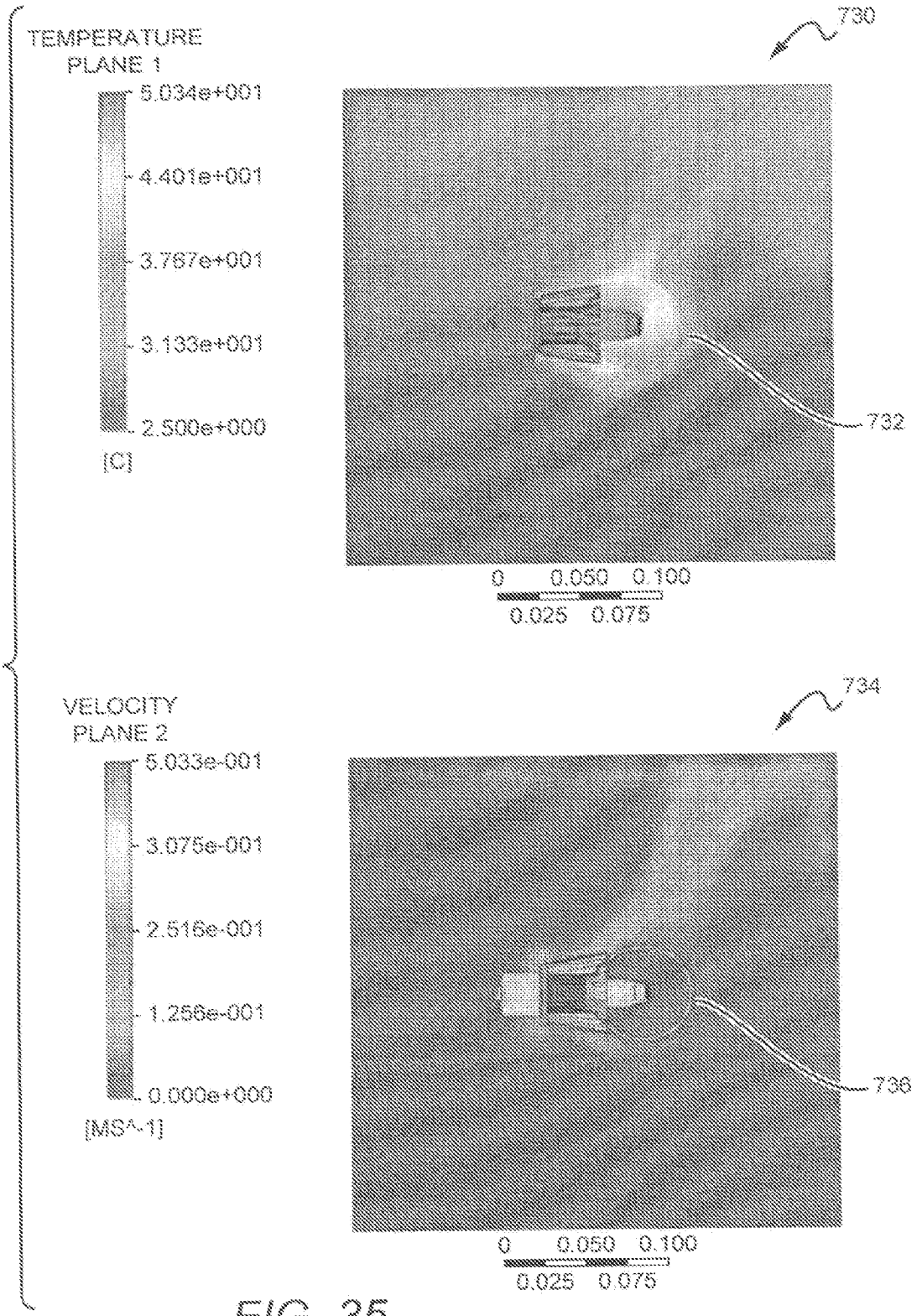
FIG. 35 shows the thermal characteristics for lamp without a fan compared to a lamp with a fan.

Beyond the reduction in convective thermal resistance, another advantage of the integrated fan module design is illustrated in FIG. 35. Image 730 shows the build-up in heat in a lamp 732 in lateral orientation. Image 734 illustrates the heat dissipation provided in a lateral lamp 736 having a fan according to the present invention. The heat sink convective thermal resistance in lamp 734 is relatively insensitive to luminaire spatial orientation with forced convective flow from the fan element. In contrast, pure natural convection can have greater than 20% variation in convective thermal performance based on the orientation of the heat sink fins. It is worth noting that 0.5 m/s forced flow from the fan in the simulation is relatively low, corresponding to about 1 CFM (cubic foot per minute). This air flow rate is approximately 20 times lower than a typical CPU cooling fan.

With the help of the forced flow from the fan element, the heat sink fins 708 of the heat sink 702 can be made much denser, further increasing convective heat transfer by increasing surface area. Denser heat sink fins can be difficult to achieve with pure natural convention, because a dense fin structure to a greater degree blocks the natural convective flow and decreases convective heat transfer. The fan element with minimum amount of power consumption can markedly reduce the system convective thermal resistance for these denser fin arrangements. This allows lower junction temperature of the LEDs and that of phosphor materials, leading to better luminous efficiency of the system and better reliability. A better thermal system allows the LEDs to be driven at higher current, thereby reducing cost per lumen output.

As mentioned above, the fans can be arranged in many different locations in the lamps to provide air flow over in different areas or over different features of the lamp. FIGS. 36 through 38 show another embodiment of a lamp 740 according to the present invention that comprises a heat sink 742, with LEDs 744 mounted in planar orientation at the top of and in thermal contact with the heat sink 742. A base/socket 746 is mounted to the heat sink 742, opposite the LEDs 744. The base/socket can be arranged similar to the base/socket 710 shown in FIGS. 28 and 29. The base/socket 746 can comprise a feature that allows the lamp 740 to be screwed into an Edison socket and can also comprise drive or power conversion circuitry as described above. In this embodiment, a portion of the base/socket 746 arranged within the core 754 of the heat sink 742.

The lamp 740 further comprises a phosphor carrier 748 and diffuser dome 750 that can be made of the same materials described above and can have the different arrangements as described above. Diffuser dome and conversion carrier can also be arranged as described in U.S. patent application Ser. No. 12/901,404, to Tong et al., filed on Oct. 8, 2010, and is entitled "Non-Uniform Diffuser to Scatter Light Into Uniform Emission Pattern." This application is incorporated herein by reference. It is also understood can be arranged with only diffuser or only phosphor carrier.

The lamp 740 further comprises an internal fan 752 that is arranged within the core 754 of the heat sink 742 at the top of the base/socket 746, and below the LEDs 744. The fan can be similar to the fan 714 described above in reference to FIGS. 30 to 32, and can have many of the size and operating characteristics. Like the fan 714, the fan 752 should be modulized, reliable, low noise and consume very little additional power.

The fan 752 can also be electrically connected to the base/socket 746 for its operating power. The fan 752 can also be arranged to conduct an electrical signal from the base/socket 746 to the LEDs 744. As first described below, the fan 752 draws air from outside the lamp, into the heat sink core 754 and into the diffuser cavity 756. The air is introduced through the heat sink core 754 and diffuser cavity 756 and exits the diffuser cavity providing a lamp air flow that carries away lamp heat generated during operation and allows the lamp operate at reduced temperatures.

Referring again to FIGS. 36 through 38, the heat sink 742 comprises lower heat sink inlets 758 that allow air to enter the heat sink core 754 when the fan 752 is in operation. Although the inlets 758 are shown at a particular location in the heat sink 742 it is understood that they can be many different locations and there can be many different number of inlets. The inlets 758 can be arranged to provide the desired air flow over the heat sink 742 as air is drawn into the heat sink core 754. After being drawn into the core 754, the fan 752 flows air into the diffuser cavity 756 through diffuser cavity inlets 760 that are adjacent the LED 744.

FIG. 37 best shows the positioning of the phosphor carrier and diffuser dome on the heat sink 742. Phosphor carrier phantom line 762 shows the location of the lower edge of the phosphor carrier 748 on the heat sink 742. The diffuser cavity inlets 760 are within the lower edge of the phosphor carrier as shown by phantom line 762. Air that enters the diffuser cavity 756 through the diffuser cavity inlets enters at the inside of the phosphor carrier 748. The air circulates within the phosphor carrier 748 and then passes to the inside of the diffuser through slots 766. The air then at least partially circulates within the diffuser dome. As best shown by phantom line 764, the lower edge of the diffuser dome can overlap the openings between the heat sink fins 743 such that the air from the slots 766 can than pass out of the diffuser cavity over the heat sink fins 743.

This arrangement provides for the embedding of the fan in the heat sink cavity/core 754 such that it is not directly visible from the outside and the fan noise is further reduced. This arrangement also provides for an internal air flow to the lamp. As shown in FIG. 38, the fan 752 draws cool air from outside the lamp 740, through the lower inlets 758 near the base of the heat sink 742. The air is drawn through the heat sink core 754 and over the base/socket 746, where the air can cool the circuitry therein. The air then flows into the diffuser cavity 754 where it can pass over the LEDs and agitate otherwise stagnant air within the diffuser cavity 756. This flow of air results in increased air pressure within the diffuser cavity 756 compared to that outside the lamp. This difference in pressure results in air being forced out of the diffuser cavity 756 at the edge of the diffuser dome overlapping the heat sink 742. In some embodiments it can be particularly helpful to maximize the air flow through the internal spacing between the heat fins. This forced air flow breaks the boundary air layer allowing cooler air to displace stagnant warmer air trapped in the spacing between the fins.

When the air is drawn into the heat sink core 754 or flows out of the diffuser cavity 756, at least a portion of the air can flow over the heat sink fins 753. This forced air flow can agitate the air within the fins, breaking the boundary air layer and allowing cooler air to displace the stagnant warmer air boundary layer in the interspacing between fins. This continuous flow of air through the lamp 740 provide and effective arrangement for reducing the convective thermal resistance at different locations within the lamp 740. This in turn enhances the overall convective heat dissipation of the lamp 740.

Simulations of the embodiment shown reflect that air flow of approximately 1 CFM (cubic foot per minute) could reduce the typical heat sink natural convective thermal resistance by almost 50%. At this air flow rate the noise from the fan is typically very low. For example, commercially available fans of the necessary size and providing the necessary air flow can have a noise level of approximately 22 dB, power consumption of 0.5 W, MTTF lifetime of 30,000 to 50,000 hours (depending on bearing material) and a cost of as low as $0.50 each.

With the convective thermal resistance reduction, the LED junction temperature can be significantly reduced. For example, if the heat sink without integrated fan has convective thermal resistance of 7° C./W (to LED input power) and 3.5° C./W with integrated fan, and LED lamp draws approximately 12 W of in input power, the LED junction temperature could be lowered by almost 40° C. with integrated fan. This leads to enhanced reliability and/or lower system cost with less LEDs being driven at higher current.

It is understood that the fan can be in included in many different lamps arranged in many different ways. FIG. 39 shows another embodiment of a lamp 780 according to the present invention that is similar to the lamp 740 shown in FIGS. 36 though 38. The lamp 780 also comprises a heat sink 782, LEDs 784, a base/socket 786 and a diffuser dome 788. It also comprises and internal fan 790 that draws in ambient air into the lamp 780. In this embodiment, however, there is no phosphor carrier, providing for a simplified airflow within the lamp. The fan 790 draws air into the lamp 780 though through the lower heat sink inlets 792 and flows the air into the diffuser dome through diffuser inlets 794. Air then circulates within the diffuser dome 788 and passes over the LEDs. This helps agitate otherwise stagnant air and reduces the convective thermal resistance within the lamp 780. As above, the lower edge of the diffuser dome 788 overlaps the heat sink fins 796 such that air can exit the diffuser dome 788 through the spacing between the heat sink fins 796. This allows the exiting air to agitate otherwise stagnant air between the heat sink fins.

As discussed above, in different embodiments there can be many different inlet and outlet arrangements that provide different air paths within the lamp or over different features of the lamp. The present invention should not be limited to the air paths shown in the above embodiments.

Although the present invention has been described in detail with reference to certain preferred configurations thereof, other versions are possible. Therefore, the spirit and scope of the invention should not be limited to the versions described above.

We claim:

1. A solid state light source, comprising:

a light emitting diode (LED);

a heat sink with said LED in thermal contact with said heat sink;

an integral fan configured to reduce the convective thermal resistance of at least some lamp elements;

at least one electrical contact configured to pass through said integral fan so that an electrical signal applied to said at least one electrical contact is supplied to said LED;

a diffuser dome on said heat sink and over said LED; and a phosphor carrier on said heat sink and over said LED, said phosphor carrier separate from and at least partially within said diffuser dome;

said heat sink shaped to define at least two inlets, at least one of which opens adjacent to said LED and inside said phosphor carrier, such that said fan flows cool air from outside said light source into said phosphor carrier via said at least one inlet adjacent to said LED.

2. The light source of claim 1, wherein said fan is adjacent to said heat sink.

3. The light source of claim 1, wherein said fan flows air over one or more surfaces of said heat sink.

4. The light source of claim 1, wherein said fan reduces convective thermal resistance by agitating the air over at least some of said lamp elements.

5. The light source of claim 1, wherein said fan is internal to one of said lamp components and draws ambient air internal to said lamp.

6. The light source of claim 1, wherein said fan is internal to said heat sink and draws air into said heat sink and flows air into said diffuser dome.

7. The light source of claim 1, wherein said phosphor carrier is configured so that at least some light from said LED passes through said phosphor carrier.

8. The light source of claim 7, wherein said phosphor carrier is a three-dimensional structure.

9. The light source of claim 1, wherein said fan is modular.

10. The light source of claim 1, further comprising a base for connecting to a source of electrical power.

11. The light source of claim 10, further comprising drive electronics integral to said base.

12. The light source of claim 10, wherein said fan is between said base and said heat sink.

13. The light source of claim 1, wherein said diffuser dome disperses light from said LED.

14. A solid state light source, comprising:

a light emitting diode (LED);

a heat sink with said LED in thermal contact with said heat sink;

an integral active air agitation mechanism configured to reduce the convective thermal resistance of at least some lamp elements, said air agitation mechanism comprising at least one electrical contact configured to pass through said air agitation mechanism so that an electrical signal applied to said at least one electrical contact is supplied to said LED;

a diffuser dome on said heat sink and over said LED; and a phosphor carrier between said heat sink and said diffuser dome; said phosphor carrier on said heat sink and separate from said diffuser dome said heat sink shaped to define at least two inlets, at least one of which opens adjacent to said LED and inside said phosphor carrier, such that said active air agitation mechanism flows cool air from outside said light source into said heat sink and then into said phosphor carrier via said at least one inlet opening adjacent to said LED.

15. A solid state light source, comprising:

a plurality of light emitting diodes (LEDs);

a heat sink comprising fins, said heat sink configured in relation to said LEDs so that said LEDs are in thermal contact with said heat sink;

an integral fan configured to flow air over the surfaces of said heat sink to reduce the convective thermal resistance of said heat sink;

at least one electrical contact configured to pass through said fan so that an electrical signal applied to said at least one electrical contact is supplied to said plurality of LEDs; and a phosphor carrier in thermal contact with said heat sink; and a diffuser dome on said heat sink and over said LEDs, said phosphor carrier between said heat sink and said diffuser dome, wherein said integral fan flows cool air through said heat sink and then into said phosphor carrier;

wherein at least a portion of said fins are outside the footprint of the base of said diffuser dome.

16. The light source of claim 15, further comprising a base, wherein said fan is adjacent to said heat sink between said base and said heat sink.

17. The light source of claim 15, wherein said phosphor carrier is configured so that at least some light from said LEDs passes through said phosphor carrier.

18. The light source of claim 17, wherein said phosphor carrier is a three-dimensional structure or planar.

19. The light source of claim 15, wherein said fan is modular.

20. The light source of claim 16, wherein said base further comprises drive electronics.

21. The light source of claim 20, wherein said drive electronics provide electrical inputs to said fan and said LEDs.

22. The light source of claim 15, wherein said diffuser dome disperses light from said LEDs.

23. A solid state light source, comprising:

a plurality of light emitting diodes (LEDs);

a heat sink comprising fins and a mount surface, said heat sink configured in relation to said LEDs so that said LEDs are in thermal contact with said heat sink;

a fan internal to said solid state light source and configured to flow air over surfaces of said solid state light source to reduce the convective thermal resistance at said surfaces;

at least one electrical contact configured to pass through said fan so that an electrical signal applied to said at least one electrical contact is supplied to said plurality of LEDs; and a diffuser cavity over said LEDs; and a phosphor carrier between said heat sink and said diffuser cavity; said phosphor carrier on said heat sink and separate from said diffuser cavity said heat sink shaped to define at least two inlets, at least one of which is through said mount surface and adjacent to said LEDs and inside said phosphor carrier, such that said fan flows cool air from outside said light source into said heat sink and then into said phosphor carrier via said at least one inlet adjacent to said LEDs;

wherein at least a portion of said fins are outside the footprint of the base of said diffuser dome.

24. The light source of claim 23, wherein said fan is internal to said heat sink.

25. The light source of claim 23, wherein said fan draws air from external to the internal of said heat sink.

26. The light source of claim 23, wherein said fan is configured to flow air into said diffuser cavity.

27. The light source of claim 23, said fan moving air over and between said heat sink fins.

28. The light source of claim 26, further comprising an outlet to allow air to exit from said diffuser cavity.

29. The light source of claim 23, wherein said phosphor carrier is three-dimensional.

30. The light source of claim 23, further comprising a base for connecting to a source of electrical power.

31. The light source of claim 30, wherein said base is at least partially internal to said heat sink.

32. The light source of claim 31, wherein said fan flows air over said base.

33. A solid state light source, comprising:

a plurality of light emitting diodes (LEDs);

a heat sink comprising fins, a mount surface, and a heat sink core, said LEDs on and in thermal contact with said heat sink;

a fan within said heat sink core;

at least one electrical contact configured to pass through said fan so that an electrical signal applied to said at least one electrical contact is supplied to said plurality of LEDs;

a base having drive electronics, said base mounted to said heat sink at least partially within said heat sink core;

a diffuser dome mounted to said heat sink over said LEDs; and a phosphor carrier between said heat sink and said diffuser dome; said phosphor carrier on said heat sink and separate from said diffuser dome said heat sink shaped to define at least two inlets, at least one of which is through said mount surface and adjacent to said LEDs and inside said phosphor carrier, said fan drawing air into said heat sink core and then flowing the air into said phosphor carrier via said at least one inlet adjacent to said LEDs;

wherein at least a portion of said fins are outside the footprint of the base of said diffuser dome.

34. A solid state light source, comprising:

a plurality of light emitting diodes (LEDs);

a heat sink with said LEDs on and in thermal contact with a top surface of said heat sink;

a fan, said fan comprising at least one electrical contact configured to pass through said fan so that an electrical signal applied to said at least one electrical contact is supplied to said plurality of LEDs;

a base comprising drive electronics, said base on said heat sink with said fan between said base and said heat sink;

a diffuser dome on said heat sink over said LEDs; and a phosphor carrier between said heat sink and said diffuser dome; said phosphor carrier on said heat sink and separate from said diffuser dome said heat sink shaped to define at least two inlets, at least one of which is adjacent to said LEDs and inside said phosphor carrier and through said top surface, said fan flowing air over the surfaces of said heat sink and then into said phosphor carrier via said at least one inlet adjacent to said LEDs.

35. A solid state light source, comprising:

a plurality of light emitting diodes (LEDs);

a heat sink in relation to said LEDs so that said LEDs are in thermal contact with said heat sink;

an active element configured to flow air over surfaces of said light source to reduce the convective thermal resistance at said surfaces;

at least one electrical contact configured to pass through said active element so that an electrical signal applied to said at least one electrical contact is supplied to said plurality of LEDs;

a phosphor carrier in thermal contact with said heat sink; and a diffuser dome on said heat sink and over said LEDs and said phosphor carrier, said phosphor carrier between said heat sink and said diffuser dome and separated from said LEDs and said diffuser dome, wherein said active element draws air into said heat sink and then into said phosphor carrier via at least one air inlet adjacent to said plurality of LEDs.

* * * * *